US006406267B1

(12) United States Patent
Mondiere

(10) Patent No.: US 6,406,267 B1
(45) Date of Patent: Jun. 18, 2002

(54) EXTRACORPOREAL CIRCULATION PUMP

(76) Inventor: Claude F. Mondiere, W 5110 San Felipe, Houston, TX (US) 77056

( * ) Notice: Subject to any disclaimer, the term of this patent is extended or adjusted under 35 U.S.C. 154(b) by 0 days.

(21) Appl. No.: 09/595,984

(22) Filed: Jun. 16, 2000

(51) Int. Cl.[7] ..... F04B 19/34
(52) U.S. Cl. ..... 417/53; 47/477.13
(58) Field of Search ..... 417/474, 475, 417/476, 477.1, 477.13, 53, 63, 9

(56) References Cited

U.S. PATENT DOCUMENTS

| | | | | |
|---|---|---|---|---|
| 3,784,323 A | | 1/1974 | Sausse | |
| 4,131,399 A | | 12/1978 | Calvet | |
| 4,218,197 A | | 8/1980 | Myer | |
| 4,492,531 A | | 1/1985 | Kenji | |
| 4,515,589 A | | 5/1985 | Austin et al. | |
| 4,886,431 A | | 12/1989 | Sonderquist | |
| 4,976,593 A | | 12/1990 | Miyamoto | |
| 5,069,661 A | | 12/1991 | Trudell | |
| 5,125,450 A | | 6/1992 | Tamari | |
| 5,222,880 A | * | 6/1993 | Montoya et al. | 417/477 |
| 5,281,112 A | | 1/1994 | Montoya et al. | |
| 5,318,413 A | | 6/1994 | Bertoncini | |
| 5,342,182 A | | 8/1994 | Montoya et al. | |
| 5,486,099 A | | 1/1996 | Montoya et al. | |
| 5,643,172 A | | 7/1997 | Kung et al. | |
| 5,846,061 A | | 12/1998 | Ledebuhr et al. | |

* cited by examiner

*Primary Examiner*—Charles G. Freay
(74) *Attorney, Agent, or Firm*—Tim L. Burgess

(57) ABSTRACT

A peristaltic pump employs an adjuster to provide facility to change flow rate without changing pump speed during operation of a pump comprising a distensible, compliant segment of header tubing stretched around rollers mounted 120 degrees apart on a rotating wheel, and a tensioner to impose additional stretch to the leading segment of header tubing contained between two rollers as that segment is released from the leading roller. The additional stretch imparts a pulsatile flow to the expressed fluid.

27 Claims, 9 Drawing Sheets

EXTRACORPOREAL CIRCULATION PUMP

FIELD OF THE INVENTION

This invention relates to pumps used in the circulation of blood from the body for treatment and return back into the body, a process called extracorporeal perfusion or circulation, and more particularly to peristaltic pumps of the flexible wall type deformed by a rolling or sliding engagement member.

BACKGROUND OF THE INVENTION

Extracorporeal Circulation

Cardiopulmonary Bypass and Cardiac Assist

Extracorporeal perfusion is used for the most part in cardiac bypass surgery. In a total bypass, all the patient's systemic venous return blood is diverted from the right side of the heart into an extracorporeal circuit, emptying the chambers of the heart. The circuit includes a heart-lung machine that comprises a pumping function and an oxygenation function, completely taking over cardiopulmonary function for the patient, returning oxygenated blood to the aorta. In a partial bypass only a portion of the blood is diverted to the extracorporeal circuit, the remaining flow passing to the lungs and from the lungs through the coronary and systemic arterial circulation. Partial bypass usually is temporarily used following total bypass surgery to slowly give the heart work to do, measurely decreasing flow through the heart-lung machine, until the heart is weaned from assist and can fully take over its pumping role.

Some procedures using blood pumps in extracorporeal circulation do not include an oxygenation function. These include cardiac assist procedures. In these, the blood pump provides higher systemic blood pressure and more blood flow than can be provided by a failing heart. A "fem-fem" (femoral vein to femoral artery) circuit is commonly used. Cardiac assist is also sometimes used if, after open heart surgery, the left side of the heart responsible for pumping to the body oxygenated blood returned from the lungs does not resume its pumping role despite attempts at weaning. If other assist circulatory devices are unsuccessful, the left heart may be bypassed to the aorta by cannulation of the left atrium, with the blood that has been oxygenated by the lungs being withdrawn through the cannula and pumped to the aorta extracorporeally without extracorporeal oxygenation.

Pulmonary Bypass

Another use of extracorporeal circulation is "extracorporeal life support" also called "extracorporeal membrane oxygenation" known by their respective acronyms of"E-CLS" or "ECMO", for simplicity herein called only ECMO. As opposed to the more conventional extracorporeal circulation in substitution or assist of the cardiac function, ECMO connotes the application of such support to supply oxygenation where the native lungs are compromised. This is especially useful for neonates, including premature birth babies, whose life is threatened because their immature lungs cannot provide adequate gas exchange. Another use is resuscitated drowning victims whose lungs are damaged and unable to supply adequate oxygenation without restorative healing. The extracorporeal circulation provides oxygenated blood to the patient's lungs under the impetus of the patient's native heart and gives time to allow healing of the lungs to occur until the lungs can take over oxygenation. In excess of 1,000 ECMO procedures are conducted annually in the United States.

Extracorporeal Circuit Components and Priming Volume

The basic components of the extracorporeal circuit for a conventional heart-lung machine are one or more venous cannulas, a venous reservoir, an oxygenator and heat exchanger, a pump, an arterial line filter, an arterial cannula, and a control module. The ECMO system includes a blood pump, a membrane oxygenator, a countercurrent heat exchanger to warm the blood, and a control module. In the typical extracorporeal circuit, deoxygenated blood drains by gravity into the circuit and flows into the venous reservoir, usually placed 25 to 30 inches below the plane of the great veins. If the oxygenator is a bubble type, the reservoir is incorporated into a oxygen-blood mixing chamber. In any case, the reservoir is placed upstream to the pump, for reasons amplified below, to prevent negative pressure in the inlet line. A water heat exchanger is used for the perfusate to control body temperature. Blood filters are used to trap particulate and gaseous emboli. The arterial cannula is usually placed in the ascending aorta but can be placed downstream in the arterial system where the vessel is large enough to accommodate the necessary flow.

Extracorporeal Circuit Pumps

The blood pump is the "heart" of the extracorporeal perfusion circuit. In general, extracorporeal circulation systems use either an occlusive compression peristaltic roller pump or a non-compressive centrifugal pump. Both produce flow rates on the order of several liters per minute, thus apply well to adult usage requirements.

Roller Pump

The basic roller pump consists of two rollers, 180 degrees apart, that rotate in a circle through a half circular raceway. A length of flexible tubing between ¼ and ⅝ inch inner diameter is placed between the rollers and the raceway. The rollers rotating in a circular movement compress the tubing against the raceway, squeezing the blood ahead of the rollers. The rollers are set to almost completely occlude the tubing, and operate essentially as a positive displacement pump, each passage of a roller through the raceway pumping the entire volume of the fluid contained in the tubing segment between the rollers. As a positive displacement pump, high positive pressures can be generated at the pump outlet and high suction (negative) pressures can be generated at the pump inlet. Roller pumps are typically driven by a constant speed motor which draws blood at a substantially constant rate. As a constant speed positive displacement pump, if a line downstream of the pump becomes occluded, the pump can over pressurize and rupture the downstream vessel, producing a "blowout", with perfusate loss from the circuit and cessation of blood flow to the patient. If a line upstream of the pump becomes occluded, the pump can generate dangerously low negative pressures that can hemolyze the blood, and can empty the tissue vessel of the patient causing a collapse of the vessel resulting in damage to the tissue at the drainage catheter tip. Cavitation, or drawing of dissolved gasses from the blood, can occur when strong negative pressures develop.

Inlet suction risk is reduced through the use of a venous reservoir (which may be part of an oxygenator). The venous reservoir gives capacitance to the suction line and prevents imbalance between suction and discharge volumes, although at a cost of additional priming volume. However, when venous return to the extracorporeal apparatus is by gravity into an open reservoir, a decrease in venous return to the oxygenator without a corresponding output reduction can lead to accidental emptying of the oxygenator and infusion of air. The rate of blood inflow to the oxygenator is basically controlled by the position and size of the venous cannula and by the height difference between the venous cannulation site and the oxygenator. The blood output of the pump is directly controlled by the rate of blood pumping.

No matter what method is used to accomplish venous return, when venous volume depletion starts, fluctuations in blood flow rates also occur. When the great veins are emptied of their contents and venous collapse occurs, further increases in suction do not accomplish more blood flow but only further aggrevate venous collapse.

Another risk with the roller pump is that the work applied on the tubing creates a friction that causes abrasion and wear of the flexible tubing. This wear can cause accidental rupture. The abrasion can cause "spallation" or interior shedding of small particles that if returned to the native circulatory system can cause emboli formation.

Centrifugal Pump

Numerous surgical services limit the complications derived from roller pumps by using non-compressive pump centrifugal pumps. Centrifugal pumps rapidly rotate an impeller in a stationary blood compartment. The impeller may be a series of blades that push the blood forward, or it may be nested concentric cones of increasing diameter to propel the blood forward by centrifugal force. In nested concentric cone centrifugal pumps, flow is a function of outflow line pressure, so these pumps have advantage over the bladed impeller centrifugal pumps and the roller pumps, namely, the nested concentric cone centrifugal pumps do not produce high back pressures when the downstream tubing is temporarily obstructed. However, both bladed impeller and nested concentric cone centrifugal pumps can produce negative pressure when inflow is impeded. All centrifugal pumps require a significant acceleration of blood flow to maintain a constant flow as outlet pressure is increased. The liquid circulation rates in the heads of centrifugal pumps range, in general, from 2000 to 4000 revolutions per minute. Interventions can only be for a short period of time and it is difficult to adapt them to low volume requirements. Furthermore, the cost of pump heads is very high, which limits their use to high budget services. As in the case of compression pumps, they require constant monitoring in order to avoid the complications of the venous return flow, and they must be fitted with a safety reservoir and a filter to prevent re-injection complications.

Hemodilution Factors in Extracorporeal Circulation

About 2 liters of priming solution are required to prime an extracorporeal system for adults. Priming solution usually consists of a balanced saline solution. Blood is not normally added to the system unless the patient is anemic. A normal adult has about a gallon of blood (about 4 liters) in systemic circulation. Dilution from the priming solution accordingly reduces by half the patient's red blood cell count (hematocrit is the count of red blood cell content in blood). Red blood cells are the respiratory messengers of the blood circulatory system, carrying oxygen to cells and $CO_2$ from cells. Thus respiratory capacity is reduced about 50% in the adult during an extracorporeal circulation procedure, and hematocrit has to be watched carefully.

Both roller and centrifugal pumps tend to break up red blood cells (hemolysis). Roller pumps mash them where the tubing is pinched between the roller and raceway; centrifugal pumps rupture them during high speed circulation. Hemolysis decreases further the already reduced hematocrit of the extracorporeal perfusate. Hemolysis, if material, has to be corrected by infusion of foreign packed blood cells or blood transfusions to maintain physiological respiration at safe levels.

Centrifugal pumps require the blood of the patients to have an ideal viscosity. The flow of fluids at 3,000 rpm through the head of a centrifugal pump can produce the formation of blood clots or aggregates, especially in the case of hyperinosemia (elevation of fibrin in the blood).

The large surface areas which blood contacts during extracorporeal circulation, especially with higher volumes as where reservoirs are required, leads to hypothermia and to activation of the complement system, to high activated clotting time ("ACT") levels causing bleeding complications, and, consequently, to use of significant anticoagulants, that, in turn, cause subsequent bleeding complications, which adversely affects hematocrit.

At least partially because of the inherent limitations of the foregoing systems and the henodilution factors, current guidelines in the United States do not allow continued use of extracorporeal circulation for more than 6 to 10 hours unless excepted or authorized. This eliminates the general employment of these systems for sustained blood oxygenation and/or pumping to allow damaged or compromised lung and cardiac tissues to have enough time to heal and normalize.

Certain Limitations of Roller and Centrifugal Pump Extracorporeal Circulation Systems Roller and centrifugal pump extracorporeal systems were designed for open heart surgery on adults. There is a critical need for improvement of extracorporeal circulation systems for non-adults, who are a large part of the cardiac surgery population. Some form of congenital heart disease occurs in about one in 100 newborns, amounting to about 30,000 annually in the United States. Defects can include incorrectly formed valves, septal defects, and abnormal connections of the arteries and veins. Correction of these defects requires open heart surgery. Correction of congenital heart defects is the third most common open heart surgery procedure, amounting to about 5% of the approximately 700,000 open-heart surgeries performed worldwide each year, slightly more than half of which are in the United States.

Roller and centrifugal pump extracorporeal systems produce flow rates on the order of several liters per minute, responding to requirements of adult usage. These systems are applied for children through the miniaturization of the same designs. The systems respond to downsizing less well for the youngest children and older babies, poorly for infants, and not at all for the neonates of low and very low birth weight. This is partially a matter of patient blood volume available for dilution and circulation extracorporeally, and partially a matter of the immaturity of blood clotting and immune defense mechanisms of newborns. Whereas a normal adult has about 4 liters of blood with which to afford a 50% dilution of oxygen carrying capacity caused by the needed priming volume, infants that weigh about 3 kg (6–8 pound range) have only about 1 kg or 1 liter of blood volume. Downsizing of the adult systems runs into critical priming limits with deleterious complications for neonates of low body weight nearer 2 kg (4.4 pounds), and is not feasible for neonates that have a birth weights as small as 1 kg (2.2 pounds). These low birth weight neonates have a blood volume of only about 300 ml.

As pointed out in U.S. Pat. No. 5,643,172, centrifugal pumps deployed for ECMO provide temporary circulatory support for pediatric patients, but have an operative mortality rate in the range of 5 to 25%, and the use of centrifugal pumps and ECMO is limited by higher complication rates caused by these systems. U.S. Pat. No. 5,643,172 specifies as complications a large priming volume resulting in hemodilution and failure of centrifugal pumps to supply a pulsatile flow. It points out that although some centrifugal pump "pediatric" heads and tubing require only about 150 cc, this is nearly one-half the blood volume of these newborns, and that the resulting dilution contributes to coagulation deficiencies and deleterious edematous effects on renal and cerebral functions. Further, when using ECMO, the priming volume of the whole circuit represents up to three times the patient's blood volume. Because infants up to six months of age have a poor thermoregulation system, lengthy tubing used in ECMO can promote heat loss leading to hypothermia and impaired coagulation mechanisms. Moreover, these systems require a dedicated technician during the pump run, which may last for several days.

Bleeding due to anti-coagulants, a problem with adults, is exacerbated with infants, reducing even more the borderline hematocrits. In addition, whereas an adult or older child has a well developed immune system, the infant or neonate has little or none. The total volume of liquid required for the described systems requires admixing with fluids foreign to the patient, and especially where blood transfusions are needed, is especially dangerous in newborns.

In consequence of the foregoing complications, numerous heart surgery procedures are delayed until the child is capable of withstanding the extracorporeal circulation. If this delay is not fatal, it may cause irreversible brain damage. The sooner heart or lung malformation corrections are performed, the more efficient they are. In the case of fetal distress or of an accident during the birthing delivery, the early administration of cardiorespiratory assistance can allow for a treatment without after-effects. Preemies and very low body weight neonates need the time for lung development that can be afforded by ECMO extracorporeal circulation lung assist techniques. But by the time they reach the weight (at least 2 Kg or 4.4 pounds) when they can be put on an ECMO assist, if they have survived that long, the artificial forced ventilation imposed on them in the meantime can have damaged the lung tissue past restorative healing.

The Sausse (Rhone Poulenc) Pump

A pump in the prior art which, unlike the roller pump and the centrifugal pump, is provided with regulating devices to control the available pumping volume so the output is controlled as a function of inlet pressure, was invented by A. Sausse, described in U.S. Pat. No. 3,784,323, incorporated herein by reference. This pump, originally designed for use in hemodialysis, was commercialized for a period of time by Rhone-Poulenc, S.A., as the RP.01 through RP.06 series of pumps.

The Sausse (Rhone-Poulenc) pump stretches a distensible silicon tubing of an ovoid or elliptical cross section and shape memory compliance longitudinally around pin rollers mounted 120 degrees apart on a rotating wheel, the tubing being held in place below the wheel by connectors retained in a notched fixed base. This tubing, herein called a "header" tubing, is not compressed against a raceway (as for a roller pump), but is held in tension across the rollers, restricting the lumen of the header tubing across the rollers. This segments the header tubing into portions defined by leading and trailing adjacent rollers. The rotation of the wheel moves fluid captured between adjacent rollers in the direction of the rotation. The material and thickness of the wall of the header tubing are selected so the tubing between the rollers will expand or collapse as a function of pump inlet pressure (available venous return). Collapse of the tube will restrict the flow rate of the liquid as a function of the pump inlet pressure. If the venous supply decreases and inlet pressure drops, flow rate will lessen even though the pump speed is unchanged, and the inlet line will remain filled. Consequently, no dangerously low negative pressures can occur, unlike what is possible with roller and centrifugal pumps. When outflow obstruction occurs, the liquid blocked from flowing forward can back flow, so the pump feeds nothing forward to over pressurize and burst the return line. Instead, the back flow accumulates in the stretched header tubing, which distends or expands to accommodate the additional volume. When the obstruction is released, blood flows downstream propelled by the increased stroke volume of the distended header tubing. The header tubing stretched over the rollers therefore functions as a built-in capacitance reservoir, eliminating the need for the reservoirs that are required for roller and centrifugal pumps. Accordingly, the pump is self-regulating and is remarkably safe.

The flow rate of the Sausse type pump may be considered as substitute cardiac output and pump suction volume as diverted venous return. The compliance of the header tube allows its volume to increase under the action of the suction pressure. The volume is evacuated in the form of a bolus, and its evacuation causes the tube to regain a flat shape capable for being refilled. This compliance provides a level of security that, as mentioned, is similar to that of a reservoir.

The stretched header tubing is located so that the hydrostatic head of the inlet line (venous return), relative to the lift height for the outlet line (downstream pressure, which determines maximum flow rate), does not render the pump body insensitive to changes in upstream pressure. Tension imposed on the stretched header tubing is a function of tubing wall thickness and elasticity, roller diameter, delivery pressure, pump speed and flow rate.

The physics of the Sausse type pump seems to have been misunderstood by some who have developed modified tubes for use on it, as illustrated by U.S. Pat. Nos. 5,222,880, 5,281,112 and 5,342,182, which evince the belief that the header tubing described in the Sausse design will cause high negative pressures if inlet flow is obstructed; these patents call for a normally collapsed inextensible tube held taunt under spring tension of a mount. Later developments (U.S. Pat. No. 5,486,099) call for a combination of the naturally collapsed occluded line with a naturally non-occluded line.

Because the Sausse type pump does not require a venous reservoir, priming volumes for an extracorporeal circuit can be much smaller than with circuits using roller or centrifugal pumps. Hence, there is less dilution of a patient's blood, so patient hematocrit can be maintained higher without red blood cell augmentation. This makes the Sausse type pump well adapted for employment in extracorporeal systems for infants. Use of the Sausse type pump for ECMO in normal birth weight infants and babies has been described by Chevalier, J. Y., Durandy Y., Basses A. et al., "*Preliminary Report: Extracorporeal Lung Support for Neonatal Acute Respiratory Failure*," Lancet 1990, vol. 335, pp 1364–1366; and by Trittenwein, G., Furst, G., Golej et al. "*Preoperative ECMO in Congenital Cyanotic Heart Disease Using the AREC System*," Ann. Thorac Surg 1997, vol. 63, pp 1298–1302.

The RP.01 through RP.06 pumps manufactured by Rhone Poulenc employed varying size rotating wheels and several fixed lengths of header tubing retained over a wheel by a fixed header locator to vary volumetric capacity and stroke volume, hence flow rate. With a chosen diameter of rotating wheel and length of header tubing, the blood flow rate for a particular venous influx and pump RPM cannot be modified without stopping the pump and changing either the wheel or the header tubing or both. However, the pump cannot be stopped during the course of a procedure or when in a life support mode.

Pulsatile Flow

Non-pulsatile flow is physiologically abnormal. Centrifugal pumps deliver an essentially continuous flow. Roller pumps and the Sausse type pump deliver a shallow or "soft"

sine wave pulse that is essentially non-pulsatile, that is, it is too shallow to provide the physiological benefits of native pulsatile flow. Pulsatile flow is important for cerebral oxygenation and autoregulation, and for other tissue perfusion and capillary blood flow. Cerebral hypoperfusion is a known problem in cardiopulmonary bypass. Neonates require a pulsatile flow. Native pulsatile flow stimulates the endothelial cells that line normal blood vessels, causing them to elongate and secret local factors (endothelium-derived relaxing factor [nitric oxide] and prostaglandin $I_2$ [$PGI_2$, or prostacyclin]) into the vessel wall (intramural release) and into the blood stream (intraluminal release). These factors maintain vascular tone (vessel relaxation), inhibit clot formation on the vessel inner surface (platelet adhesion and aggregation), inhibit monocyte adherence and chemotaxis, and inhibit smooth muscle cell migration and proliferation. There are other effects. U.S. Pat. No. 5,643,172 associates failure to provide a pulsatile flow with high incidence of renal dysfunction during ECMO followed by recovery after the return to pulsatile flow.

There are a few prototypes of pulsed flow pumps which achieve said wave flow through a flap or valve that is often of porcine origin. The results are satisfactory but their use is very delicate and requires specialized personnel. These pumps cannot be used outside of services that have a significant monitoring structure in place.

SUMMARY OF THE INVENTION

It is an object of this invention to improve a Sausee type pump for use in extracorporeal circulation systems which can be employed safely for the full spectrum of patients from adults to premature babies.

It is an object of this invention to provide a pump of the Sauuse type needing no external reservoirs for system safety, thus able to pump blood extracorporeally with little priming volume dilution compared to the roller pump and centrifugal pump systems of the prior art, and adjustably able to circulate the blood at very low flow rates appropriate to the blood volume of neonates.

It is an object of this invention to provide a means of adjusting the flow rate of a Sausse type pump during operation other than by adjusting pump speed, so pump speed independent adjustment can be realized without removal of the pump from service.

It is an object of this invention to provide a Sausse type pump that outputs a pulsatile flow, important for brain perfusion during cardiopulmonary bypass procedures for all ages and in extracorporeal life support systems for neonates.

It is an object of this invention by employing the self regulation capabilities of the Sausse type pump, as improved with this invention, to provide a low maintenance pump suitable for use by patients from neonates to adults, yielding the stated objectives, that does not require extensive monitoring while the patent is on-pump, thus affording deployment not only to larger national and international surgical centers, but also, because of its simplicity and low maintenance needs, to smaller health centers, worldwide, with the compactness to be portable for remote third world countries visited by humanitarian medical teams to perform locally needed cardiopulmonary surgeries, especially on children.

This invention provides an improved Sausse type peristaltic pump and method of pumping that meets these and other objects of the invention. In accordance with this invention, these improvements comprise means and methods for changing the flow rate of the pump by adjusting the tension of the header tubing of a Sausse type pump while the header tubing is stretched across said rollers and the pump is operating. Another improvement is provision of means and methods for imparting a pulsatile wave motion to fluid expressed from the pump.

The invention, as an improved Sausse type pump, employs a distensible shape memory compliant silicon elastomeric header tubing ellipsoid in relaxed cross sectional aspect. With such an elastomer, the more stretch that is imparted to the header tubing, the more compliance is decreased; and the lesser the stretch imparted, the more the compliance of the elastomer can be used to increase the diameter of the tube. The distance between leading and trailing rollers, the ellipsoid size (relaxed cross sectional area) and the radial expandability of the header tubing when stretched between the leading and trailing rollers at the particular fluid pressure of the extracorporeal circuit determines the stroke volume of the fluid segment captured between the pins. The more tension imparted into the length of header tubing stretched between adjacent pins, the greater the expulsive force expressed on the stroke volume when the captured segment is discharged by the pump. The greater the expulsive force, the greater the surge or pulse of the expelled volume. The invention permits more fixed tension to be imparted to header tubing of a given length for a particular wheel and tubing combination during operation of the pump, and has the facility to impart a pulsatile wave form on the expressed discharge from the pump to give a pulsatile flow in the return line of an extracorporeal circulation.

In a particular apparatus, this invention provides a peristaltic pump for pumping fluids, comprising (1) a frame having (2) a plurality of rollers spaced equidistantly apart and (3) a carrier for carrying the rollers along a circular path; (4) a driver for rotating the carrier to move the rollers about a pump axis, the rollers each rotating about an axis parallel to the pump axis, the roller axes being radially equidistant from the pump axis; (4) a flexible, distensible, shape memory compliant, elastomeric header tubing elliptical in relaxed cross section, of selected length longer than twice the radial distance separating the pump axis and the axes of the rollers, the header tubing having a proximal portion with an inlet end and a distal portion with an outlet end; (5) a yoke transverse to and spaced from the pump axis a distance greater than the aforesaid radial distance and having a pair of openings at the extremities thereof for receiving and holding the proximal inlet and distal outlet ends of the header tubing spaced from the carrier, when the header tubing is spanned across the rollers with the major axis of the header tubing parallel to the axes of the rollers, such that the proximal and distal portions of the header tubing go not converge toward each other; and (6) an adjuster operatively cooperative with the yoke for moving the yoke and both the proximal and distal ends of the header tubing held in the yoke uniformly toward or away from the pump axis to change the tension on the header tubing across the rollers and increase or decrease the flow rate of liquid moved through the header tubing on rotation of the carrier at a chosen speed of rotation.

Advantageously the terminals of the proximal and distal portions of the header tubing are held in connectors that include an external rigid flange intermediate their ends, and the yoke receives the flanges for holding the header tubing stretched around the rollers according to the tension placed on the header tubing by the adjuster operative with the yoke.

In a particular apparatus form for imparting a pulsatile wave motion on fluid expressed from the pump, the pump comprises in addition to at least the elements numbered (1) through (4) above, (5) a holder transverse to and spaced from said pump axis a distance greater than said radial distance and having a pair of openings at the extremities thereof for receiving and holding said proximal inlet and distal outlet ends of said header tubing spaced from said carrier when the header tubing is longitudinally spanned across said rollers with the major axis of the header tubing parallel to the axes of the rollers, (6) an indicator on the carrier, (7) an indication receptor spaced from the indicator and responsive to the indicator to signal when the indicator is at a selected position indicating that a leading roller is approaching the distal portion of the header tubing for release of contact with the header tubing stretched across such leading roller (preferably the aforesaid selected position indicates that the leading roller is at the point of release of contact), and (8) a tensioner responsive to the signal for momentarily imparting additional stretch to the distal portion of the header tubing to narrow the passageway through the distal portion when the leading roller reaches the point of release of contact with the header tubing, whereby upon the release of contact a bolus of fluid in a segment of the header tubing between the leading roller and an immediately trailing roller is driven through the narrowed passageway of the distal portion, accelerating flow of the released bolus through the outlet to creating a pulse wave in the fluid leaving the outlet greater than afforded upon the release absent the additional stretch.

Suitably, a timer paced by the speed of rotation of the carrier outputs a signal to signal the tensioner to release the tension momentarily imparted to the distal end of the header tubing after the carrier has rotated a predetermined amount before the trailing roller has approached the point of release of contact as a leading roller.

The carrier rollers of the pump are improved over the rollers used in the RP.01 and RP.06 pumps manufactured by Rhone-Poulenc, S.A. The rollers of the present invention preferably are longitudinally arcuate in the direction of the roller axis, with a larger diameter intermediate opposite ends of the roller than the diameter of the roller at the ends of the roller, and are supported on sealed roller bearings. The rollers are stainless steel and have a surface polished to a mirror finish. These features assure minimal rolling friction against the tensed header tubing and combined with the mirror finish, work minimal friction against the stretched header tubing, assuring maximum life for the header tubing.

Longitudinally arcuate shape of the carrier rollers provide a maximum stretch on the center of such header tubing, thus creating, from the header tubing-roller contact, a restriction that is capable of segmenting the header tubing into separate fluid fillable compartments without full occlusion of the header tubing as in a roller pump; yet at the edges of the rollers, where the diameter of the rollers is smaller, less stretch is effected on the lateral portions of the header tubing, thereby leaving channels allowing blood cells to be displaced from the center of the header tubing to the channels without being hemolyzed by the pressure of the roller on the stretched header tubing at the restriction. The channels also provide fluid communication with adjacent segments of the header tubing. This facilitates back flow and avoidance of blowout pressure if the downstream return line becomes obstructed.

Suitably the pump carrier is a pair of spaced discs each on the same axis, each disc having a like diameter advantageously in the range from 6 cm to 23 cm, and the header tubing is advantageously selected from a group having respective major and minor axes having a major to minor axes ratio suitably less than 3. Particularly advantageous ratios are 12 and 9, 17 and 13, 20 and 16, 28 and 22, and 35 and 24.

The pump driver suitably includes a motor geared for increasing or decreasing the speed of the carrier and further comprises a controller operatively associated with the motor for controlling the rotational speed of the motor, and a speed selector operatively associated with the controller for generating a selected speed signal signifying a selected rotational speed for the carrier wheels. The motor suitably has a gear reducer to slow the motor speed to at least 1 rpm. A power source to the driver and circuitry include a switch connection of the power source to the rotator, a sensor for determining presence of an electrically conductive fluid on the yoke, and circuitry connecting the sensor to the switch, to disconnect the power source from the driver when an electrically conductive fluid is sensed on the yoke by the sensor.

A particular method of providing pulsatile flow in a return line of an extracorporeal circuit, in accordance with this invention, comprises stretching a portion of a flexible, distensible, shape memory compliant, elastomeric header tubing around at least two of a plurality of rollers spaced equidistantly apart on a carrier rotatable about a pump axis for carrying the rollers on a circular path, the rotors being rotatable each on their own axis parallel to the pump axis, the patency of the header tubing being restricted where it is stretched across the rollers; restraining the header tubing at an end of a proximal portion thereof and at an end of a distal portion thereof to provide a selected amount of stretching tension on the header tubing, the proximal portion end having an inlet and the distal portion end having an outlet; connecting the inlet of the proximal portion end of the header tubing to feed tubing that comprises the receiving line of the extracorporeal circuit at the distal end of the feed tubing and connecting the outlet of the distal portion end of the header tubing to return tubing that comprises a return line of the extracorporeal circuit at the proximal end of the return tubing, receiving fluid in the circuit to fill the circuit with fluid; rotating the carrier about a pump axis to advance the rollers in the circular path proceeding from a contact with the proximal portion of the header tubing to a contact with the distal portion of the header tubing, thereby defining successively segments of the header tubing between leading and trailing pairs of the rollers, each trailing roller becoming the leading roller of a rotationally following segment, each segment containing a bolus of fluid in fluid communication with a bolus in an adjacent segment of the header tubing; and momentarily imparting additional stretch to the distal portion of the header tubing to narrow the passageway through the distal portion when the leading roller of a segment reaches the point of release of contact with the header tubing, whereby upon the release of the contact the bolus in the segment released by the leading roller is driven through the narrowed passageway of the distal portion, thereby accelerating flow of the released bolus through outlet creating a pulse wave in the fluid in the return line greater than afforded by the header tubing upon the release absent the additional stretch.

The magnitude of the pulse wave of the pulsatile flow is managed by controlling the amount of additional stretch imparted to the distal end of the header tubing.

The operation of restraining the header tubing suitably includes holding the proximal inlet and distal outlet ends of the header tubing spaced from the carrier when the header tubing is longitudinally across at least two of the rollers, such that the proximal and distal portions of the header tubing do not converge toward each other, and moving both the inlet and outlet ends of the held header tubing uniformly toward or away from the pump axis to tension the header tubing across the rollers sufficiently to restrict the patency of the header tubing across the rollers and to decrease the relaxed compliance of the header tubing to an extent providing a selected flow rate for liquid moved through the header tubing upon rotation of the carrier.

In accordance with the invention, the stroke volume of a bolus is controlled by selecting from among factors including: the radial distance of the rollers from the pump, the profile of the relaxed cross section of the header tubing; the compliance of the header tubing; the length of the header tubing; the amount of stretch adjustment imparted to the header tubing for a particular combination of header tubing length, carrier roller longitudinal profile and cross section radius; and the speed of rotation of the carrier. Suitably the profile of the relaxed cross section of the header tubing is elliptical. With an elliptical profile, the major axis of the elliptical header tubing is parallel to the axes of the rollers when the header tubing is stretched across at least two of the rollers. Advantageously, with an elliptical profile of the relaxed cross section of the header tubing, the major and minor axis, in mm, are 12 and 9, 17 and 13, 20 and 16, 28 and 22, or 35 and 24, and the carrier rollers have diameters of 170, 190 and 230 mm.

With the foregoing factors set, flow rate can be increased or decreased as needed during operation by adjusting the tension on the header tubing in accordance with this invention.

As mentioned above, this invention is important in providing safe and flexible extracorporeal circulation for all weights and blood volumes, from adults to neonates, unlike the roller pumps and centrifugal pumps in prior art systems, in allowing adjustment of flow rates without changing pump speed, and importantly for all ages and weights, in providing a facility for imparting pulsatile flow that is necessary for brain perfusion and for neonates.

Reference is made to the data set forth below under Examples 1 through 4 for useful combinations of selections of carrier wheel diameter, header tubing profile and length, and carrier rotational speed for circulation rates appropriate for all sizes of patients, from newborns and neonates to adults. A suitable circulation rate for neonates, for example, is obtained by rotating a carrier of roller diameter of 170 mm with a header tubing of elliptical cross section profile having a major axis length of 17 mm and a minor axis length of 13 mm at a rotational speed in the range of 1 to 10 revolutions per minute to afford a circulation rate of from about 8 to about 120 ml per minute.

The ability with the present invention to circulate blood extracorporeally at very low flow rates and low dilution compared to the roller pump and centrifugal pump systems of the prior art, yet with a pulsatile wave motion, makes it possible to consider new therapies in diverse fields ranging from perinatology, such as for the treatment of fetal distress or the performance of bivalve heart interventions in newborn, to the treatment of refractory cardiac insufficiency or acute respiratory insufficiency.

The stretched pump tubing concept allows for the use of a veno-venous type cannula, which produces a flow rate in an alternate stream. According to this, the concept is used in infants. It eliminates the need for a reservoir, which is a significant advantage in the case of long term respiratory assistance provided to newborn who suffer from respiratory distress. The blood flows at low speeds under the effect of physiological pressures, allowing the cells to follow a laminar stream without significant modifications of their membrane and without any mechanical destruction. Since the patient-machine suction and discharge equilibrium is passive, there are no complications in the venous return: there are no overload or drainage complications.

For use in a bi-ventricular extracorporeal flow circuit uses, the pump of this invention also may comprise a second carrier, which suitably is provided by a third disc on the same axis as the first carrier and axially spaced therefrom, the second carrier, like the first carrier, suitably having at least three rollers rotatably mounted between the third disc and the adjacent disc of the first carrier wheel, each roller being mounted on a roller axis parallel to and equidistant from the carrier wheel axis and spaced 120 degrees apart from each other and 60 degrees apart from the rollers of the first carrier wheel, for rotation both about the axis of the second carrier and the axis of the individual rollers of the second carrier. As with the first carrier, the second carrier is supplied with a flexible, distensible, shape memory compliant elastomeric second header tubing elliptical in relaxed cross section, and of selected length longer than twice a second radial distance separating the pump axis and the axes of the rollers of the second carrier, thereby to provide a second selected relaxed volumetric capacity. The second header tubing has a proximal portion with an inlet end and a distal portion with an outlet end; and flexible second feed and second return tubing each of a relaxed cross section smaller than the relaxed cross section of the second header tubing. The second feed tubing has a distal end with an outlet and the second return tubing having a proximal end with an inlet. A second feed tubing connector has a central bore, for connecting the inlet in the proximal end of the second header tubing to the outlet in the distal end of the second feed tubing, and a second return tubing connector has a central bore, for connecting the outlet in the distal end of the second header tubing to the inlet in the proximal end of the second return tubing. A second yoke transverse to and spaced from the pump axis a distance greater than the second radial distance, has a pair of openings at the extremities thereof for receiving and holding the proximal inlet and distal outlet ends of the second header tubing spaced from the second. carrier wheel between each disc of the wheel when the header tubing is longitudinally spanned across the rollers of the second carrier wheel with the major axis of the header tubing parallel to the axes of such rollers, such that the proximal and distal portions of the second header tubing do not converge toward each other.

In the bi-ventricular mode for which the second carrier wheel is suitable, there is normally no need to increase the tension of the second header tubing because pulsatile flow is not as important as in the arterial circuit. Optionally, however, the embodiment of the pump with the second wheel may include a second indicator on the second carrier wheel and a second indication receptor spaced from the second indicator and responsive to the second indicator to signal when the second indicator is at a selected position indicating that a leading roller in the second carrier wheel is approaching the distal portion of the second header tubing for release of contact with the second header tubing stretched across such leading roller. It further would accordingly include a second tensioner responsive to the signal from the second indication receptor for momentarily imparting additional stretch to the distal portion of the second header tubing to narrow the passageway through the distal portion thereof when the leading roller reaches the point of release of contact with the second header tubing, whereby upon the release of such contact a bolus of fluid in a segment of the second header tubing between the leading roller and an immediately trailing roller is driven through the narrowed passageway of the distal portion of the second header tubing, accelerating flow of the released bolus through the outlet thereof to create a pulse wave in the fluid leaving the outlet and entering the second return tubing greater than afforded upon the release absent the additional stretch.

The invention is now described in reference to a preferred embodiment in illustration but not limitation of the novel features of the invention.

DETAILED DESCRIPTION OF THE PREFERRED EMBODIMENT

Figure 1:
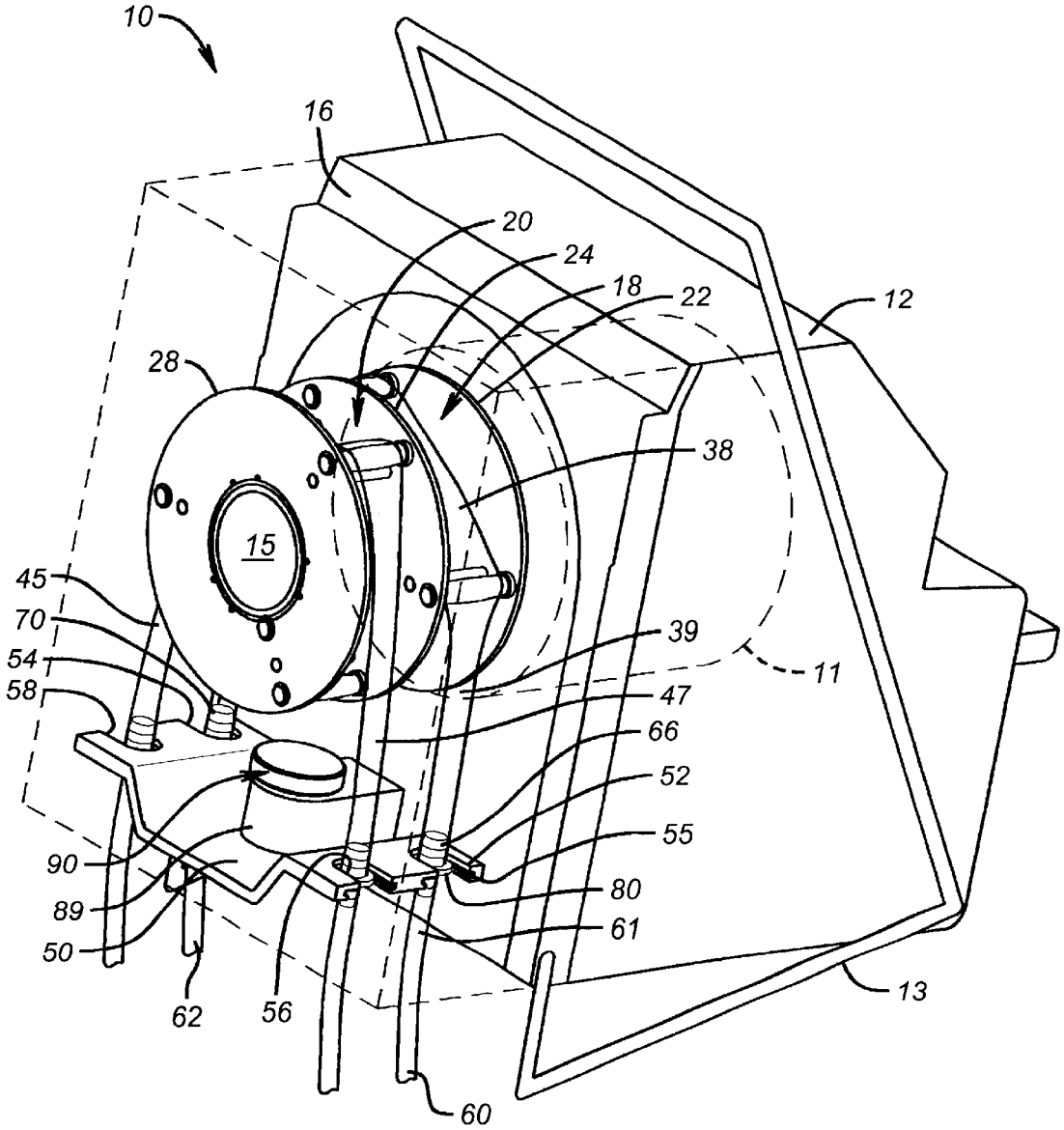
FIG. 1 is a perspective view of a two rotor pump embodiment of this invention.

Referring to FIG. 1, the pump of this invention is indicated by the reference numeral 10 and comprises a shock-proof sealed case 12 on a frame (not shown ) and case support 13. Case 12 contains a driver 1 suitably a geared motor (shown in dashed graphical outline) and pump regulation and control components. The motor is geared for increasing or decreasing the speed of the carrier and further comprises a controller operatively associated with the motor for controlling the rotational speed of the motor, and a speed selector operatively associated with the controller for generating a selected speed signal signifying a selected rotational speed for the carrier wheels. The motor suitably has a gear reducer to slow the motor speed to at least 1 rpm. A power source to the driver 11 and circuitry include a switch connection of the power source to the rotator, a sensor for determining presence of an electrically conductive fluid on the yoke, and circuitry connecting the sensor to the switch, to disconnect the power source from the driver 11 when an electrically conductive fluid is sensed on the yoke by the sensor.

Figure 2:
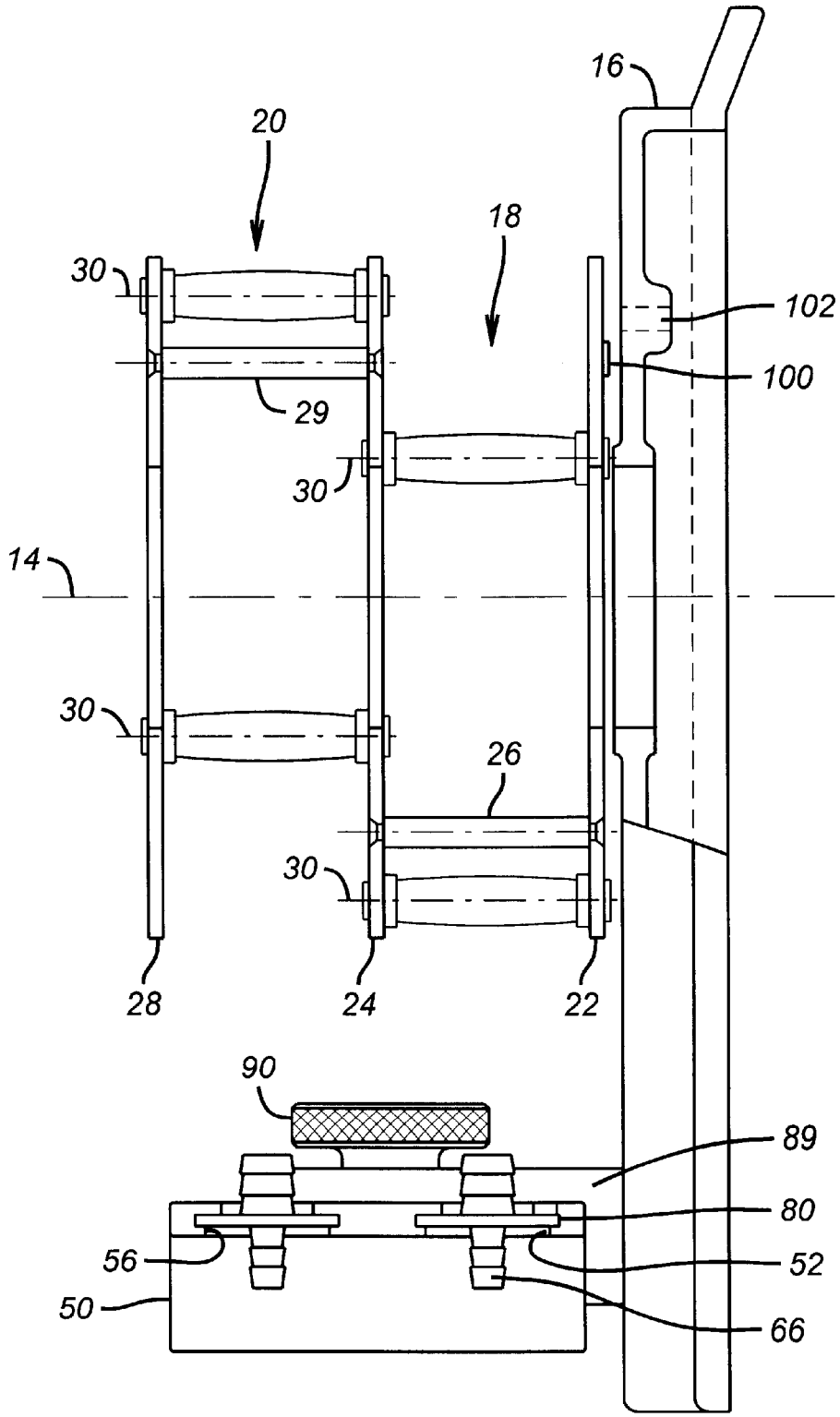
FIG. 2 is a partially broken away left side view of the pump of FIG. 1 without header tubing and along the line of 2—2 of FIG. 1.

Referring also to FIG. 2, a shaft 15 of the motor projects along an axis 14 through the front face 16 of the case 12 supported by a sealed joint located between the inner face (not shown) and front outer face 16 of the case 12.

A power supply battery pack (not shown) auxiliary to line power for the pump unit is of the type that is used with any device that operates in a mobile vehicle, whether or not motorized, in a room, or outdoors, on land or in the air. This power supply provides the pump with sufficient independent power to allow its use in all emergency systems that may require the patient to be moved.

The shaft on axis 14 supports a first carrier wheel 18 and an optional second carrier wheel 20. A pair of stacked discs 22 and 24 are axially spaced on shaft 14 by spacers 26 or any other device capable of maintaining an equal distance on the shaft between the opposing surfaces of the two discs 22 and 24, the separated discs forming carrier wheel or rotor 18. The optional second carrier wheel or rotor 20 shown in FIGS. 1 and 2 is formed in the same manner as with carrier wheel 18, with a third disc 28 and spacers 29. The rotors are attached to the shaft by a locking mechanism (not shown).

The diameter of the rotors of the pump suitably is in the range from about 60 to about 230 mm, and if used for infants and neonates, suitably is from about 170 to about 190 mm. This latter diameter corresponds generally to about 25% of the average skull diameter of infants and neonates for which this invention may be used (these are neonates ranging in birth weight from about 1 Kg to about 5 Kg).

Figure 4:
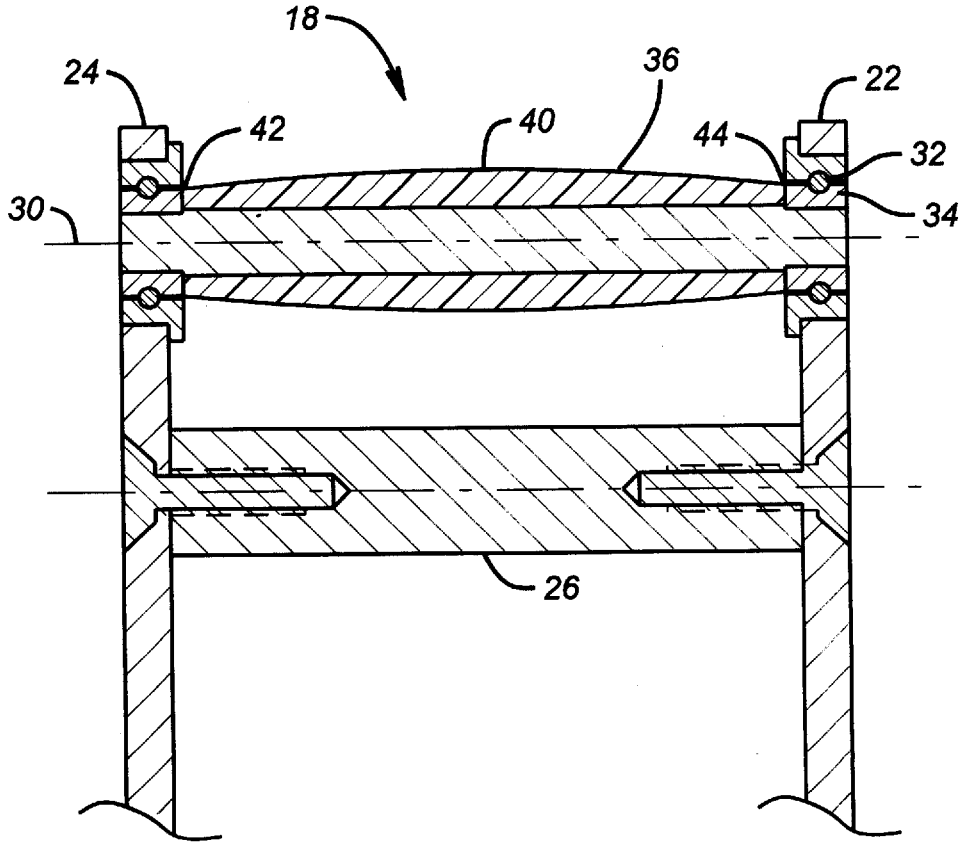
FIG. 4 is a side sectional view of a roller and spacer of a carrier wheel seen in FIG. 2.
Figure 15:
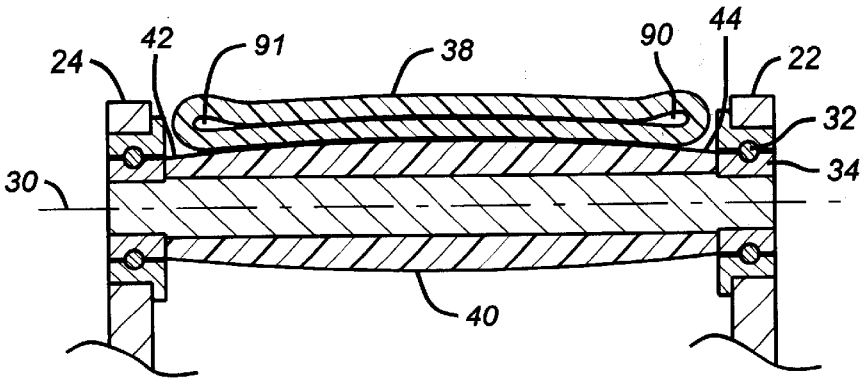
FIG. 15 is a cross section of the header tubing depicted in FIG. 14 stretched across a roller depicted in side sectional view.

Each carrier wheel 18 and 20 has at least three rollers (indicated as rollers A, B and C in FIGS. 5–13 for each carrier wheel or rotor 18 or 20. (In FIGS. 5–13, discs 24 and 26 are removed for view of the rollers A, B and C.) The rollers move in a circle on the periphery of wheels 18, 20. Referring to FIGS. 4 and 15, the rollers roll on an axis (indicated in all cases by the reference numeral 30) supported on ball bearings 32 running in a raceway case 34. The radii of the rollers are equidistant from the axis 14 of rotors 18 and 20. The rollers A, B and C consist of a hard, preferable stainless steel, sleeve with a smooth, preferably mirror, finish at the surfaces 36 thereof The smooth finish reduces friction produced by roller contact with the first tube 38 and thereby eliminates any abnormal wear that could cause the accidental rupture of first tube 38. Rollers A, B and C are placed with a spacing of 120° on each wheel. Rollers on the respective carriers 18 and 20 are spaced apart 60° from one carrier wheel to the other. Rollers A, B and C have an arcuate surface to provide a maximum stretch on the center of header tubing stretched across it to allow a volume of fluid contained in the header tubing to be defined between two adjacent rollers. The central diameter 40 of each roller is greater than the diameter of the roller ends 42 and 44.

Each wheel supports a flexible header tubing (38 on wheel 18, 46 on wheel 20), having a proximal portion, respectively 39 and 47, and a distal portion, respectively 37 and 45. Each header tubing has a portion stretched over the rollers A, B and C (see at FIGS. 1, 5–13 and 14), restricting the lumen 51 of the header tubing 38, 46 where it is stretched across the rollers A, B and C when stretch is imposed as described hereinbelow.

Flexible feed tubing 60 that comprises the receiving line of an extracorporeal circuit and return tubing 62 that comprises the return line of the circuit are connected to header tubing 38 for respectively admitting extracorporeal fluid to and receiving extracorporeal fluid from header tubing 38. Feed tubing 60 and return tubing 62 each have a relaxed cross section smaller than the relaxed cross section of header tubing 38. Feed tubing 60 has a distal end 61 with an outlet, and return tubing 62 has a proximal end 63 with an inlet. Feed tubing connector 66 has a central bore and connects the inlet of the end 68 of proximal portion 39 of header tubing 38 to the distal end 61 of the feed tubing 60. Return tubing connector 70 also has a central bore connecting the outlet of the end 72 of distal portion 37 of header tubing 38 to the inlet in the proximal end 74 of return tubing 62.

Figure 3:
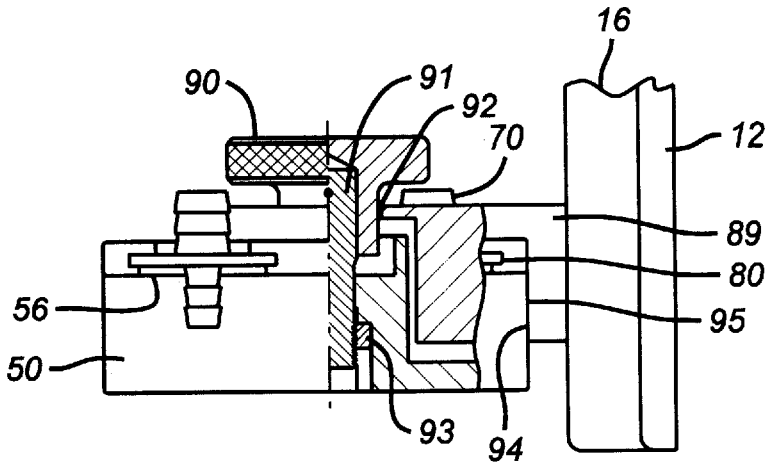
FIG. 3 is a side view in partial section of the yoke and adjuster mechanism depicted in FIGS. 1 and 2.

Referring to FIGS. 2 and 3, a bracket 89 is mounted to front face 16 of case 12. A knurled adjustment knob 90 fixedly topping a screw shaft 91 rotates on a bearing surface 92 formed on an opening 92 in bracket 89. Screw shaft 91 is received in a mating nut flight 93 formed in a yoke 50 that is transverse to and spaced from pump axis 14. Yoke rear surface 94 bears against the front surface 95 of bracket 89 fixing yoke 50 from rotation as adjustment knob 90 is turned to lift or lower yoke 50 towards and away from pump axis 14. Alternative to the mode of translating rotational motion into vertical motion depicted, adjuster 90 may be a pinion or worm moving a gear rack-type notched rail formed on yoke 50 to transform rotary motion to linear motion. Other means of suitably and securely raising and lowering a yoke uniformly relative to the pump axis are within the ordinary skill of artisans and are within the scope of this invention. The travel of yoke 50 is limited to an extent allowing it to clear carrier wheels 18, 20.

Referring to FIGS. 1–3, yoke 50 includes at least a pair of openings 52, 54 (also 56, 58 as shown in FIG. 1, for second header tubing 46) for receiving and holding pump and feed connectors 66 and 70 below the carrier wheel 18 and between each disc 22, 24 of wheel 18. The connectors 66, 70 each include an external suitably circumferential rigid flange, respectively 80, 82, intermediate their ends. Yoke 50 cooperates with flanges 80, 82, accepting them in slots 55, 57 recessed respectively in openings 52, 54 (similarly, for the second header tubing 46 of the second carrier wheel 20, in openings 56, 58) to hold header tubing 38 in tension with header tubing 38 stretched around at least two of rollers A, B and C (see, e.g., FIG. 9).

Header tubing 38 and connectors 66, 70 may be made and used as a single unit or as an assembly of three pieces; in any case, the flanges 80, 82 are included on the outer part of the respective connectors 66, 70. The header tubing 38, 46 is made of a flexible, distensible shape memory compliant, elastomeric polymer that can be stretched longitudinally and radially.

Figure 5:
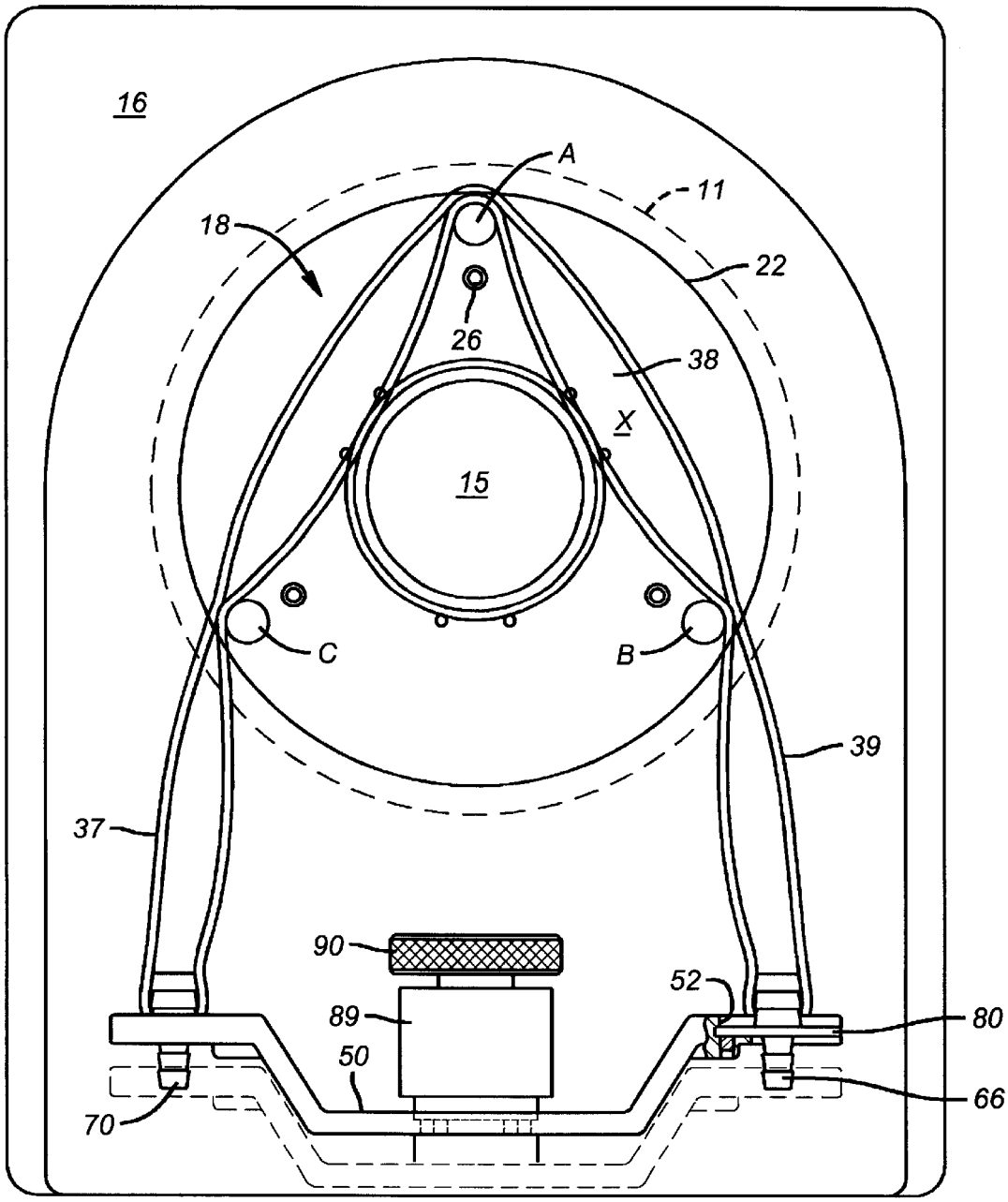
FIG. 5 is a frontal view of the pump of FIGS. 1 and 2 with the anterior carrier wheel and the front disc of the posterior carrier wheel removed, showing the yoke adjustment feature of the invention.
Figure 7:
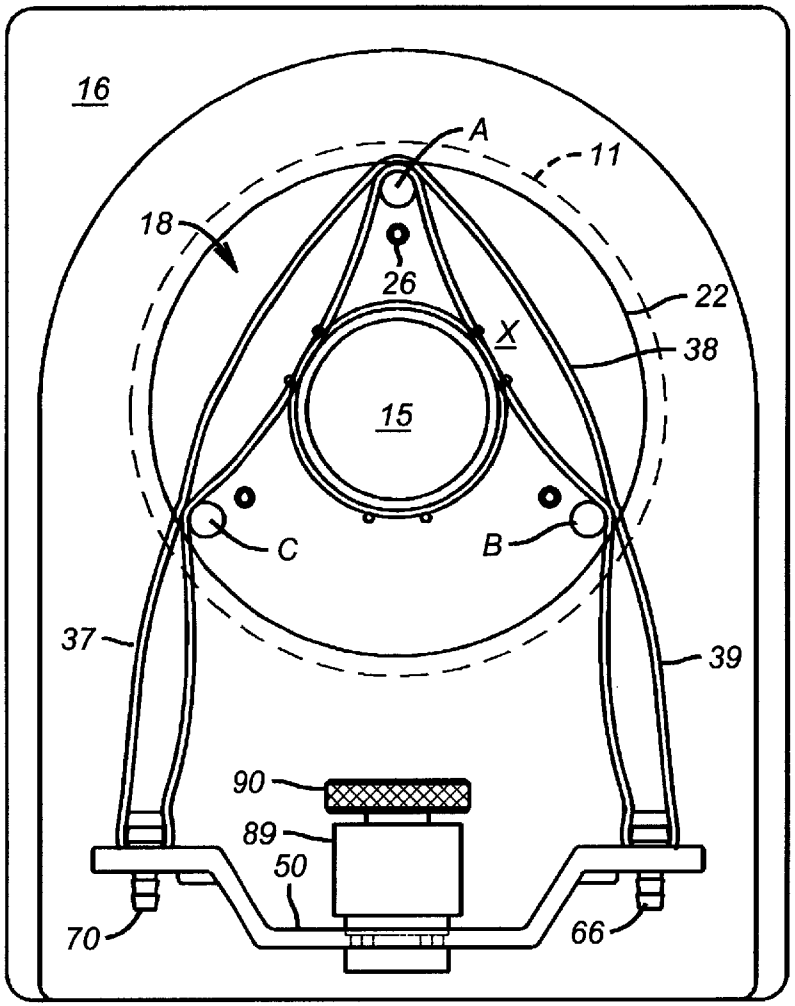
FIGS. 6–13 are frontal views of the pump of FIGS. 1 and 2 with the anterior carrier wheel and the front disc of the posterior carrier wheel removed, showing rotation of the carrier wheel and movement of fluid through the header tubing of the pump through an tire pump stroke.

Referring to FIGS. 3 and 5, adjuster 90 is operatively cooperative with yoke 50 for moving yoke 50 and both the inlet and outlet of ends of header tubing 38 (and as applicable second header tubing 46) uniformly toward and away from pump axis 14 to tension header tubing 38 across at least two of the rollers A, B and C to restrict the patency of header tubing 38 and decrease the relaxed compliance of header tubing 38 to an extent providing a selected flow rate of liquid moved through header tubing 38 upon rotation of carrier 18. FIG. 5 schematically depicts two elevations of yoke 50 provided by rotation of adjuster knob 90 to raise and lower yoke 50. The projection of the bore axis of connectors 66, 70 is substantially tangential to rotor 18. The proximal and distal portions of the header tubing are essentially normal to the yoke and do not converge toward each other.

Figure 12:
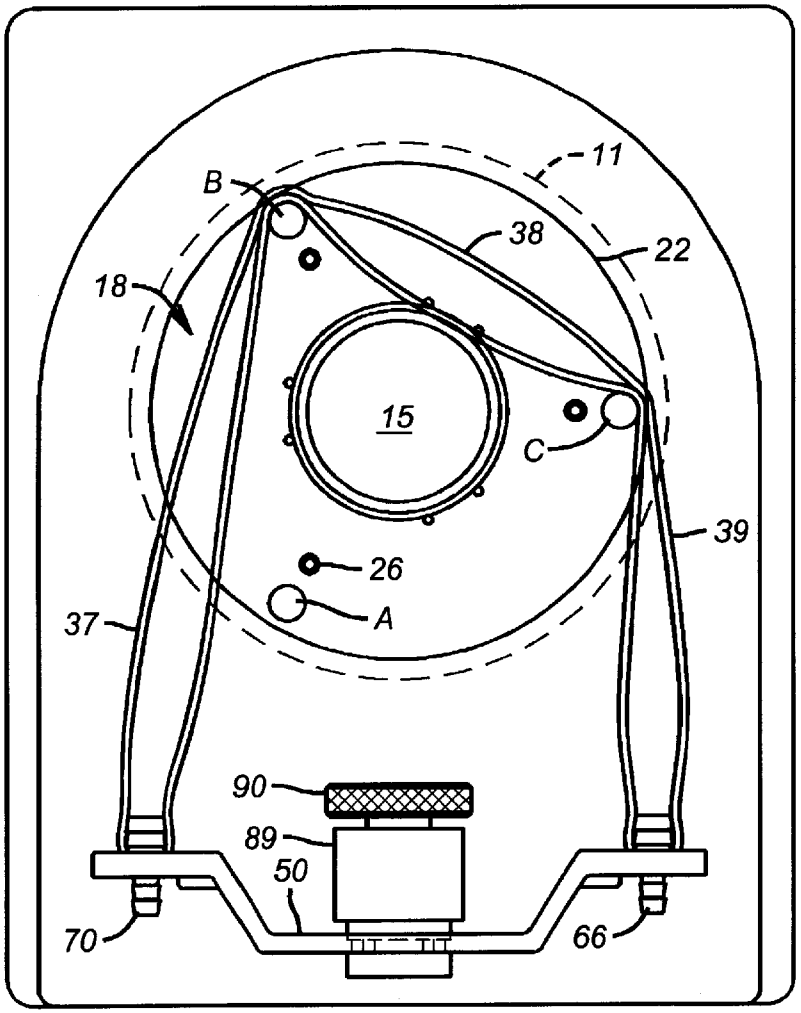
Figure 14:
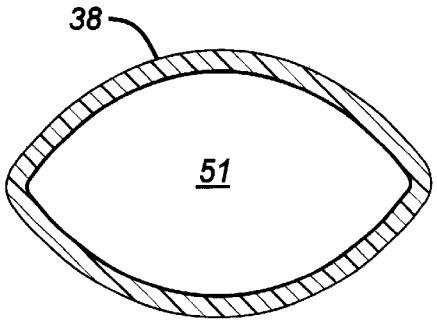
FIG. 14 is a cross section of the header tubing depicted in FIGS. 5–13.
Figure 16:
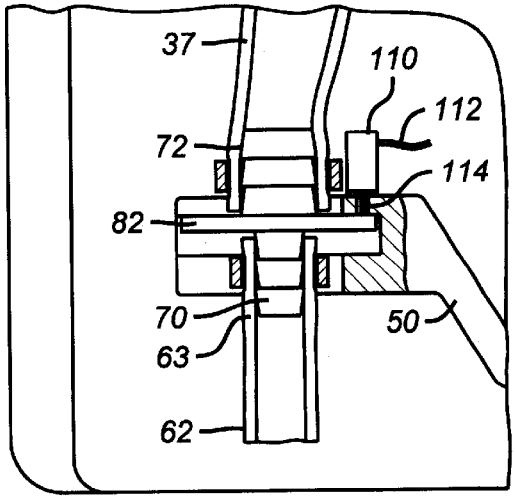
FIG. 16 is a larger frontal view in partial section of a portion of the left end of the yoke seen in FIG. 5, depicting a tensioner employed in this invention
Figure 17:
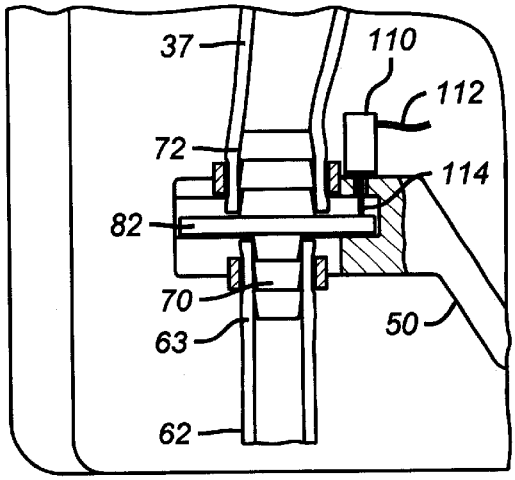
FIG. 17 is the same view as FIG. 16

Referring now to FIG. 2, an indicator 100 is on disc 22 of wheel 18 and an indication receptor 102 is spaced from indicator 100 and is responsive to indicator 100 to signal when indicator 100 is at a selected position indicating that a leading roller (say roller A) of a segment (segment X in FIGS. 5, 7–11) of header tubing 38 is approaching (approaching as used herein means nearing or at) the distal portion 37 of header tubing 38 where release of contact of the header tubing 38 stretched across such leading roller will occur (see generally FIG. 12). Referring to FIGS. 16 and 17, a tensioner comprising a solenoid 110 or other suitable mover is responsive to the signal from indication receptor 102 passing by electrical line 112, and extends a plunger 114 to impart additional stretch to the distal portion 37 of header tubing 38 to narrow the passageway through distal portion 37 when leading roller A reaches the point of release of contact with header tubing 38 (FIG. 11), whereby upon said release of contact a bolus of fluid in a segment (segment X in FIGS. 5, 7–11) of the header tubing between leading roller A and an immediately trailing roller (roller B in FIGS. 5, 7–12) is driven (FIG. 13) through the narrowed passageway of distal portion 37, accelerating flow of the released bolus through the outlet of distal portion 37, creating a pulse wave in the fluid leaving the outlet. The pulse wave is greater than afforded upon release absent this additional stretch, and imparts a sharp sine wave pulse sufficient to stimulate endothelial cells in the receiving blood vessels of the patient.

Indicator 100 may be any location along carrier 18. Suitably a timer paced by the speed of rotation of said carrier can output a signal to indicator receptor 102 to signal the tensioner to release the tension momentarily imparted to the distal end of said header tubing after the carrier has rotated a predetermined amount before the trailing roller has approached the point of release of contact as a leading roller.

Alternatively, not shown, the connector 70 for the discharge line 63 is held by a removable clip. This clip is maintained by its own control device. It is activated by a downward movement that causes the stretching of the header tubing 38. This stretching causes the volume of fluid to be ejected from the header tubing 38 that is connected to the return tubing to the re-injection cannula. The lowering of the clip is determined by a signal such as described above or in another form when the roller passes through the upper left quarter of the circle traced by the roller assembly. Suitably the signal consists of a magnetic, optic or any other type of marker that is capable of indicating the position of the roller to the machine, and which transmits the signal to the discharge connector assembly, causing the stretching of the distal portion 37 of the header tubing 38 and forcing out the volume that is contained between the trailing roller B and the discharge end 37 of said header tubing 38. This stretching produces enough force to propel the discharge volume. The force of the ejection generates a pulse wave on the walls that is strong enough to be transmitted to the connection of the arterial system. This produces a pulsatile flow that is particularly efficient with small volumes.

Figure 6:
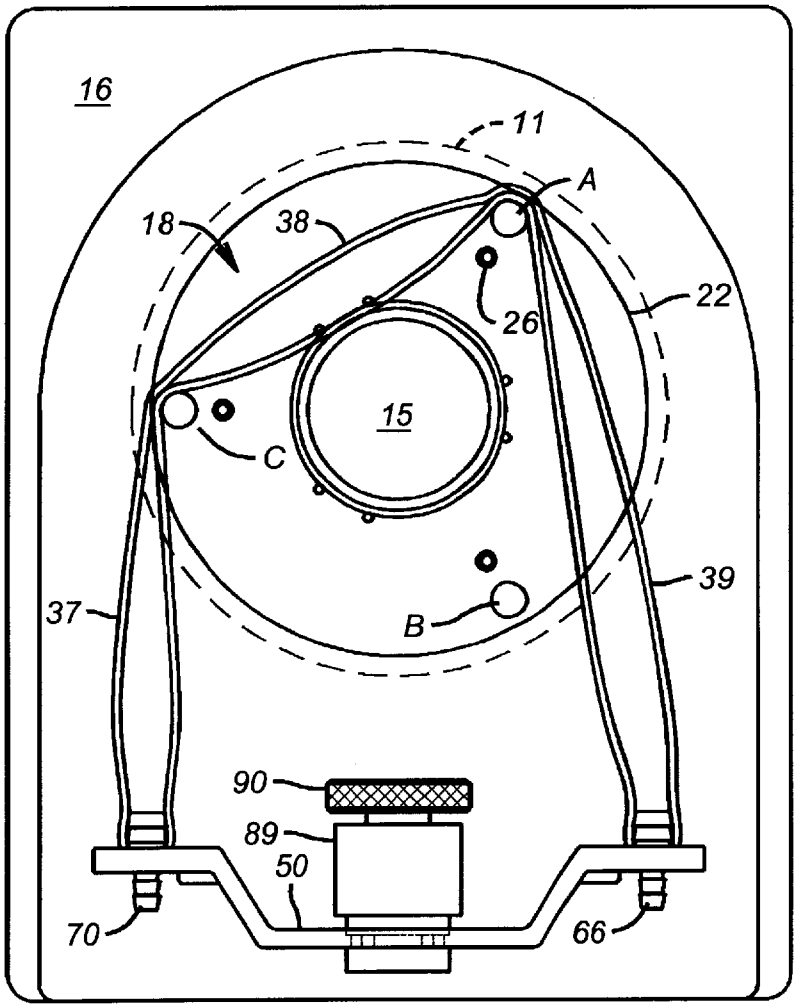
Figure 9:
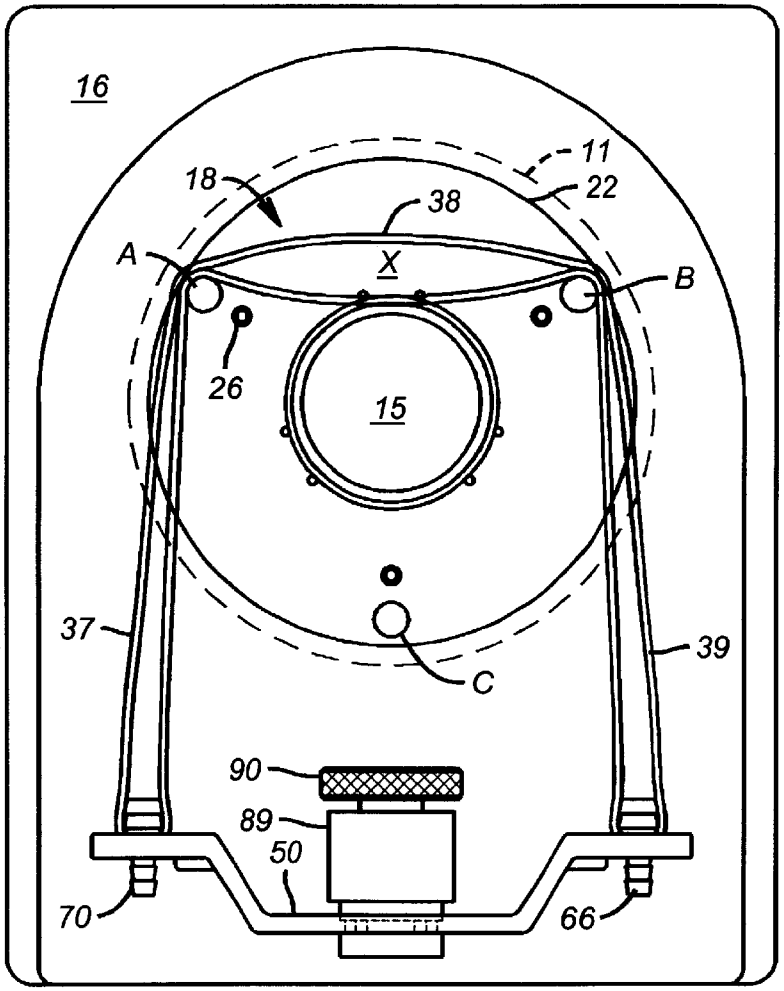
Figure 8:
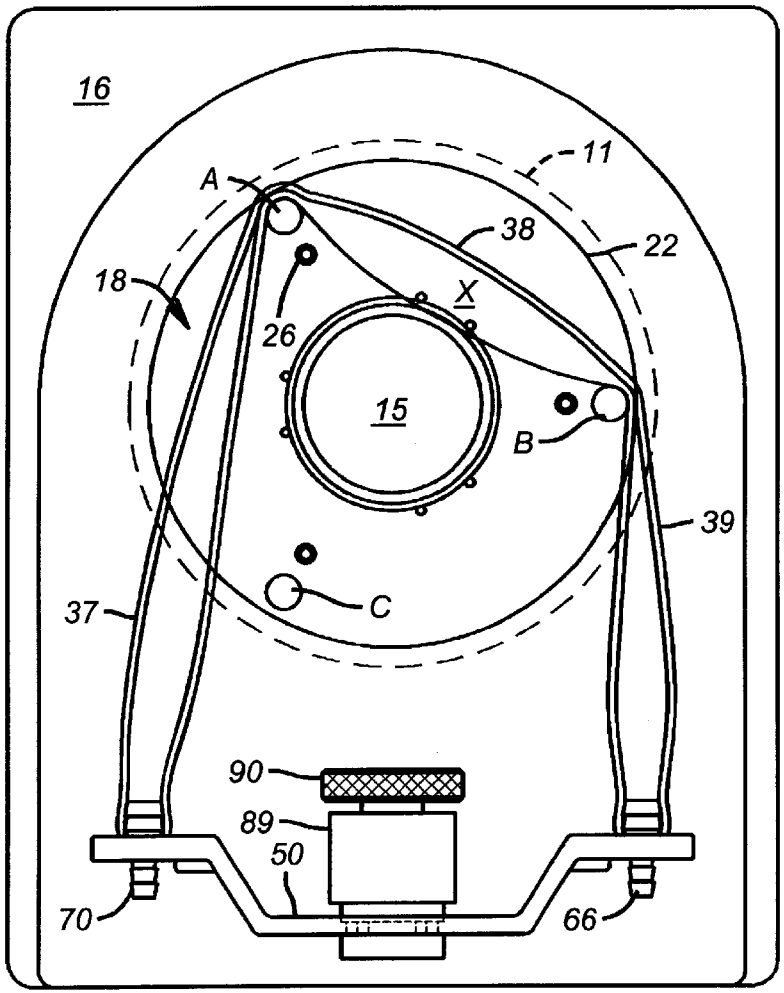
Figure 11:
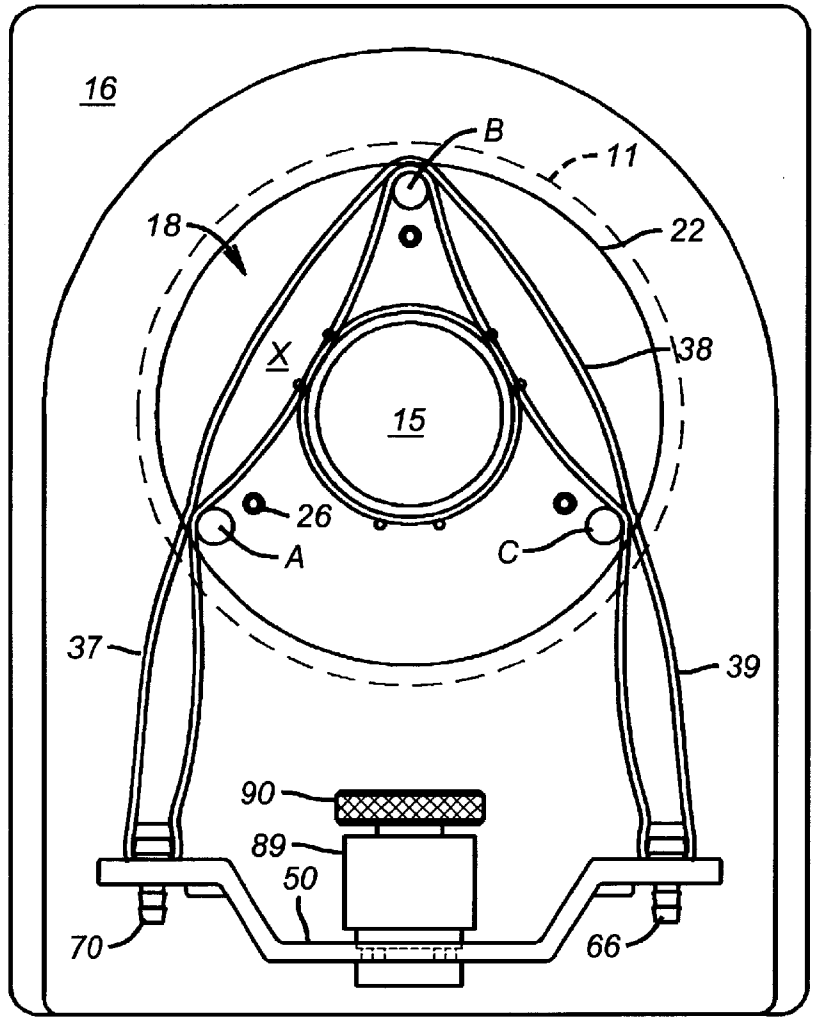
Figure 10:
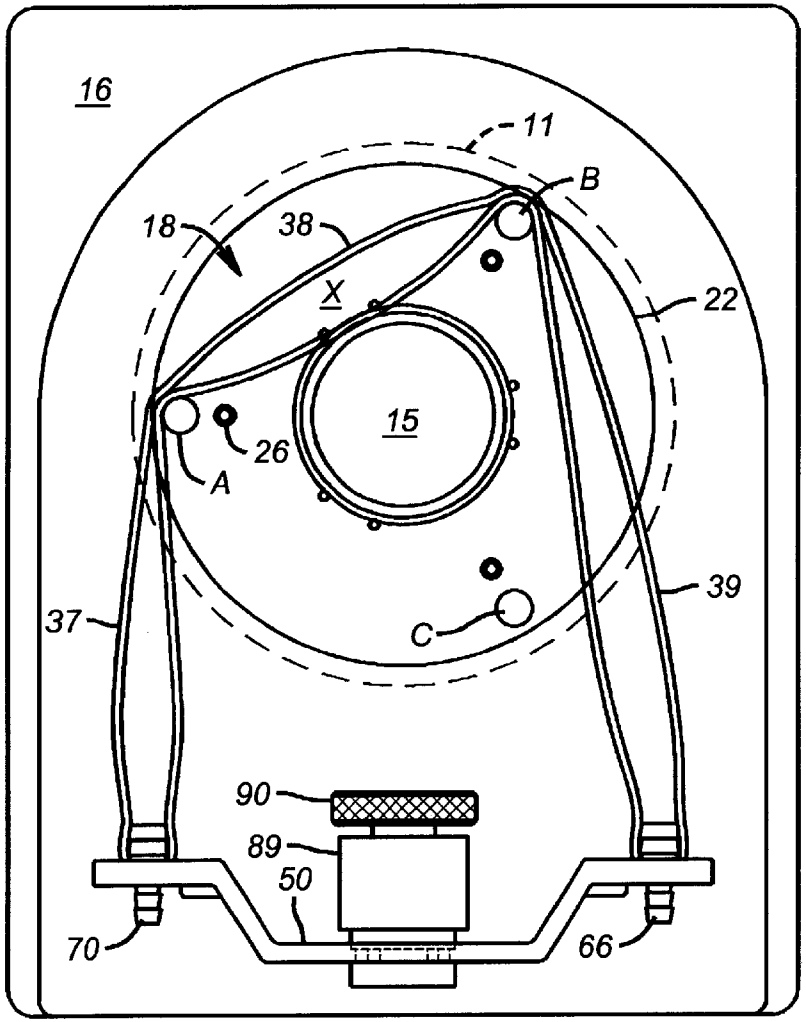
Figure 13:
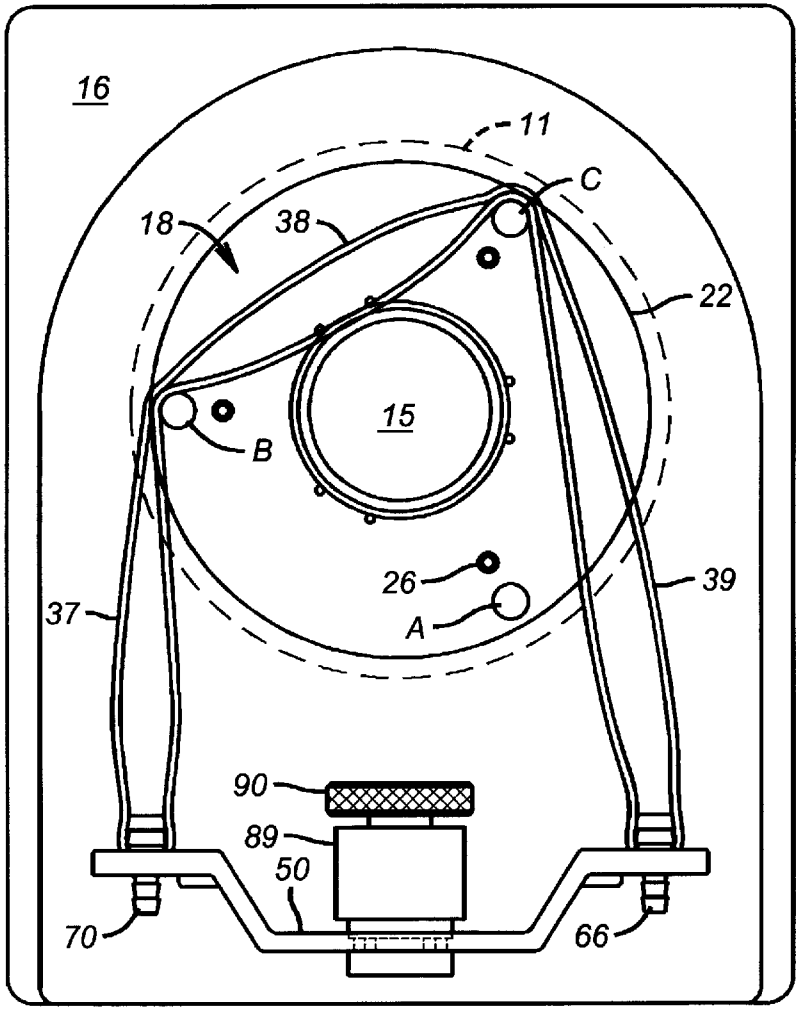

In operation, the filling of the pumping bodies 38 and 46 is performed passively, through the venous return flow of the patient that is diverted into feed tubing 66 to the proximate end of the pump bodies 38, 46. The suction pressure is equal to that of the venous system plus a gravity or hydrostatic head pressure given by the distance between the level of the venous cannula and the level of the 12 o'clock position of a rotor (FIG. 5) of the pump. Normally the appropriate gravity head will be provided by a distance on the order of 20 to 30 inches. The internal pressure of the tube 38, 46 increases during filling until it reaches a plateau. This plateau represents the equilibrium point between the stretching forces of the incoming flow and the stretch resisting forces of the tube wall of 38, 46 at a given tension imposed by adjuster 90 operative with yoke 50. The plateau is maintained during the transition from the filling phase to the evacuation phase described below. Referring to FIG. 6, when carrier 18 rotates, a trailing roller B contacts pump header tubing 38 at the top of proximate portion 39 ,and causes a restriction marking the end of a segment "X" in which passage of liquid to the outlet of header tubing 38 is restrained both at the end of the segment and at the front of the segment by an immediately preceding leading roller A. FIGS. 6–13 depict the progress of trailing roller B and leading roller A as carrier 18 rotates, rolling captured segment X forward (counterclockwise in the drawings) over rollers A and B, until the point near release of leading roller A (FIG. 11) and after release (FIG. 12), when roller A is now being rotated forward to become a trailing roller (FIG. 13) to restrict the end of another segment for which roller C is the leading roller. As already described, an additional stretch is imparted to the distal portion 37 of header tubing at the point of release of header tubing by leading roller A, causing a greater surge of fluid through the narrowed passageway that provides a pulse wave through the return tubing leading back to the patient.

If an obstruction occurs downstream from the pump, the fluid proximal of the inclusion can back flow, so the pump feeds nothing forward. The back flow accumulates in the header tubing 38, and until the pressure in the header tubing equals the drive pressure of the venous drainage and gravity head, the volume of header tubing 38 increases as header tubing 38 expands, potentially becoming rounded overall, when the limit of elasticity is reached, maximizing back pressure to stop any drive pressure remaining. When an obstruction occurs upstream from the pump, the extracorporeal circulation is simply stopped, the header tubing becomes flat without generating any negative pressure, and creates a natural barrier.

The deformation of the tube that is caused when the tube is stretched by the roller forces the cells out to the periphery (FIG. 15) and creates a flowing channel on the creases 97, 98 of the tube. In this case, the device is considered non-occlusive. With this type of movement, the circulating cells are displaced by the physiological pressures; they are deformed without being crushed. A very low rate of hemolysis occurs.

When the tube is stretched over the roller, the roller applies a pressure on the tube which causes the header tubing to be pinched. The surface 40 of the rollers is as already mentioned, curved. During the contact with the pump body 38, the central part of the roller applies a tension on the pump body 38 that is greater on the center than on the periphery. The external creases of the pump body 38 are no longer in contact with the surface of the roller. As a result, lateral channels are formed. This roller geometry generates a non-occlusive flow which, in the vertical position, constitutes a safety device against any presence of air.

The invention may also be modified for use as a suction pump to remove blood from a surgical field or the like. In order to obtain the full occlusion, the surface of the roller must be flat. A full occlusion provides for a smooth suction. This geometry is used during operations to recover the blood of the patient and re-inject it in the extracorporeal circulation. The suction without compression is efficient to preserve blood that has already been altered by the surgical procedure.

Experiments

The following comments demonstrate the wide range of flow rates suitable with the base Sausse type pump geared to provide very low revolutions per minute (rpm's), enabling flow rates suitable for neonates all the way up to adults.

System header tubing is size selected for the particular volume duty needed. Size selection is made according to patient body weight. Four cross sectional sizes in two lengths in combination with a selection of three rotor sizes provide a complete spectrum for all duty needs:

Size 1: Neonates and Organ Perfusion

Size 2: Infants to 20 Kg

Size 3: Children larger than 20 Kg

Size 4: Adults.

In performing experiments such as those set forth below when employing a pump system as described immediately above, certain considerations are involved in making appropriate selections from among factors including the radial distance of the rollers from the pump; the profile of the relaxed cross section of the header tubing; the compliance of the header tubing; the length of the header tubing; the amount of stretch adjustment imparted to the header tubing for a particular combination of header tubing length, carrier roller longitudinal profile and radius; and the speed of rotation of the carrier. Axial tension on the system header tubing is regulated by selection of rotor size (selection of roller radius) and the length of the header tubing. For any header tubing size, a larger rotor diameter (a larger rotor axis to roller axis radius) increases the stroke volume of a bolus (the volume defined between adjacent rotor pins). For a given rotor size, increasing the tubing size increases the flow capacity of the pump system. Increasing the RPM of the rotor increases the flow rate of the pump system.

All experiments were performed following this defined protocol: A circuit composed by a reservoir of liquid made by 20% of glycerol and 80% of distilled water, a heat exchanger to maintain the temperature at 37° C., one membrane oxygenator, and a peristaltic pump of the type described above using the stretching concept to propel the inlet volume through the outlet. The header tubing was made from silicone elastomer. PVC connectors joined the header tubing to the inlet and discharge ends of the circuit. The experiments used elliptical or ovoid header tubing of four different relaxed cross section widths and two different lengths with three different sizes of rotors. For tube size no. 1, the internal pressure of the circuit was set at 120 mmHg; for tube sizes nos. 2, 3, and 4, it was set at 250 mmHg. Flow rates were obtained for the various header tubing size and rotor size combinations with 1 different rotor speeds ranging from 1 to 50 rpm.

EXAMPLE 1

Tubing Size 1 (Neonates), 120 mm Hg, 37° C.

| Run | 1 | 2 | 3 |
|---|---|---|---|
| TubingSize (mm) | 17 × 13 | 17 × 13 | 17 × 13 |
| Tubing Length (cm) | 45 | 45 | 47 |
| Rotor Size (cm) | 17 | 19 | 17 |
| RPM | ml/min | ml/min | ml/min |
| 1 | 8 | 27 | 16 |
| 5 | 50 | 90 | 76 |
| 10 | 120 | 190 | 160 |
| 15 | 190 | 310 | 270 |
| 20 | 290 | 440 | 380 |
| 25 | 360 | 530 | 480 |
| 30 | 440 | 650 | 570 |
| 35 | 520 | 770 | 680 |
| 40 | 610 | 900 | 790 |
| 45 | 690 | 1030 | 890 |
| 50 | 790 | 1160 | 1090 |

EXAMPLE 2

Tubing Size 2 (Infants), 250 mm Hg, 37 ° C.

| Run | 1 | 2 | 3 | 4 |
|---|---|---|---|---|
| Tubing Size (mm) | 20 × 16 | 20 × 16 | 20 × 16 | 20x16 |
| Tubing Length (cm) | 45 | 45 | 47 | 47 |
| Rotor Size (cm) | 17 | 19 | 17 | 23 |
| RPM | ml/min | ml/min | ml/min | ml/min |
| 1 | 32 | 60 | 40 | 100 |
| 5 | 110 | 190 | 160 | 300 |
| 10 | 230 | 360 | 340 | 530 |
| 15 | 360 | 570 | 510 | 770 |
| 20 | 500 | 770 | 700 | 1020 |
| 25 | 630 | 940 | 870 | 1260 |
| 30 | 790 | 1090 | 1030 | 1500 |
| 35 | 920 | 1270 | 1210 | 1720 |
| 40 | 1060 | 1440 | 1380 | 1950 |
| 45 | 1220 | 1630 | 1560 | 2210 |
| 50 | 1360 | 1810 | 1740 | 2450 |

EXAMPLE 3

Tubing Size 3 (Children), 250 mm Hg, 37° C.

| Run | 1 | 2 | 3 | 4 | 5 |
|---|---|---|---|---|---|
| Tubing Size (mm) | 28 × 22 | 28 × 22 | 28 × 22 | 28 × 22 | 28 × 22 |
| Tubing Length (cm) | 47 | 47 | 49 | 49 | 49 |
| Rotor Size (cm) | 17 | 19 | 17 | 19 | 23 |
| RPM | ml/min | ml/min | ml/min | ml/min | ml/min |
| 1 | 60 | 120 | 35 | 175 | 192 |
| 5 | 200 | 320 | 220 | 480 | 520 |
| 10 | 430 | 670 | 500 | 1010 | 1130 |
| 15 | 660 | 1010 | 810 | 1440 | 1560 |
| 20 | 890 | 1370 | 1130 | 1870 | 2090 |
| 25 | 1110 | 1650 | 1410 | 2280 | 2360 |
| 30 | 1340 | 1980 | 1730 | 2670 | 2760 |
| 35 | 1570 | 2280 | 2030 | 2980 | 3190 |
| 40 | 1820 | 2560 | 2290 | 3310 | 3590 |
| 45 | 2040 | 2820 | 2480 | 3560 | 3920 |
| 50 | 2230 | 3030 | 2740 | 3760 | 4160 |

EXAMPLE 4

Tubing Size 4 (Adult), 250 mm Hg, 37° C.

| Run | 1 | 2 | 3 | 4 | 5 |
|---|---|---|---|---|---|
| Tubing Size (mm) | 35 × 24 | 35 × 24 | 35 × 24 | 35 × 24 | 35 × 24 |
| Tubing Length (cm) | 47 | 47 | 49 | 49 | 49 |
| Rotor Size (cm) | 17 | 19 | 17 | 19 | 23 |
| RPM | ml/min | ml/min | ml/min | ml/min | ml/min |
| 1 | 98 | 124 | 103 | 209 | 200 |
| 5 | 366 | 610 | 430 | 800 | 806 |
| 10 | 730 | 1160 | 760 | 1490 | 1760 |
| 15 | 1100 | 1660 | 1080 | 1980 | 2260 |
| 20 | 1450 | 2130 | 1360 | 2510 | 2910 |
| 25 | 1820 | 2550 | 1620 | 2930 | 3556 |
| 30 | 2160 | 2850 | 2130 | 3190 | 4130 |
| 35 | 2450 | 3100 | 2300 | 3390 | 4700 |
| 40 | 2750 | 3250 | 2700 | 3650 | 5180 |
| 45 | 2950 | 3390 | 3030 | 4100 | 5860 |
| 50 | 3130 | 3750 | 3360 | 5100 | 6320 |

The results of Examples 1–4 show that within limits of the circuit pressure, pump discharge volume (flow rate) can be increased or decreased in pump set-up by two alternative mechanisms, giving an initial wide range of operator choice:

1. At a fixed RPM, by increasing or decreasing axial tension of the header tubing between the roller pins, either by using a larger or smaller wheel or by selecting the length of the tubing as shorter or longer to increase stretch of the header tubing over the same wheel.

2. For a given longitudinal tension of the header tubing determined by wheel diameter and header tubing length, pump discharge volume can be increased or decreased by changing the RPM. RPM of the SP06 can be varied form about 1 RPM to about 50 RPM. According to -selection of sizes of the header tubing and the rotor, augmented by the flexibility for imparting additional header tubing axial tension using the header tubing mount adjuster, the pump discharge of the SP06 was set to as little as 8 ml/min to as much as 6350 ml/min, allowing it to be used with great system reserve from neonate to adult applications.

The non-occlusive characteristic of the pump system with arcuate rollers means the pump discharge volume always equals the venous inflow volume. Despite capability of the pump system to increase flow by increasing axial tension for a selected header tubing size, operation of the pump system at higher flow rates will not increase actual return flow to the patient beyond that permitted by the venous inflow, because the resistance offered by the patient's circulatory system will radially expand the header tubing to the extent allowed by the radial elasticity for the axial tension selected by the rotor size and the header tubing end mount adjustment; and when the volume capacitance of the header tubing is reached, the resistance; will prevent further venous inflow from the patient, regardless of how much speed is dialed into the pump system. So in effect, the patient's circulation system will set the maximum useful rpm for the pump system.

This invention may be used with a single pump supporting a single rotor, using a single veno-venous type cannula that allows for an alternate flow. The same single-rotor pump may use a double cannula, one being venous and the other arterial. This invention allows for a device with a double pump design, one being placed under the patient and providing a venous flow, while the second provides an arterial pulsed flow and is placed at the level of the patient in order to restore as much as possible the pulse wave. This invention may be integrated into a compact device that consists of a single pump fitted with a double rotor; this double rotor may be used as a reservoir, as a safety device, or, as in the case of the double pump, to simulate a venous circuit and an arterial circuit. This second wheel can also be occlusive and act as a suction pump. In this case, the pump body is connected to the re-injection circuit.

This pump is an efficient therapeutic tool for low-weight patients, intended for applications that may need to be sustained for hundreds of hours, such as the cardiopulmonary assistance provided to hypotrophic newborn that require this type of assistance either to undergo treatment or to allow for a surgical procedure.

I claim:

1. A peristaltic pump for pumping fluids, comprising:

a frame having a plurality of rollers spaced equidistantly apart and a carrier for carrying the rollers along a circular path, a driver for rotating said carrier to move said rollers about a pump axis, said rollers each rotating about an axis parallel to the pump axis, the roller axes being radially equidistant from the pump axis, a flexible, distensible, shape memory compliant elastomeric header tubing elliptical in relaxed cross section having a selected major to minor axis ratio, and of selected length longer than twice the radial distance separating said pump axis and said axes of said rollers, thereby to provide a selected relaxed volumetric capacity, said header tubing having a proximal portion with an inlet end and a distal portion with an outlet end, means for adjusting the tension of said header tubing while said header tubing is stretched across said rollers and said driver is rotating said carrier.

2. The pump of claim 1 in which said means for adjusting tension is further characterized in comprising:

a yoke transverse to and spaced from said pump axis a distance greater than said radial distance and having a pair of openings at the extremities thereof for receiving and holding said proximal inlet and distal outlet ends of said header tubing spaced from said carrier when the header tubing is longitudinally spanned across said rollers with the major axis of the header tubing parallel to the axes of the rollers, such that the proximal and distal portions of the header tubing do not converge toward each other, an adjuster operatively cooperative with said yoke for moving said yoke and both said inlet and outlet ends of the header tubing held in said yoke uniformly toward or away from said pump axis to tension the header tubing across said rollers sufficiently to restrict the patency of the header tubing across the rollers and to decrease the relaxed compliance of the header tubing to an extent providing a selected flow rate for liquid moved through said header tubing upon rotation of said carrier.

3. The pump of claim 1 further comprising means for imparting to fluid expressed from said pump a pulsatile wave motion.

4. The pump of claim 3 in which said means for imparting pulsatile flow is further characterized in comprising:

an indicator on said carrier and an indication receptor spaced from said indicator and responsive to said indicator to signal when said indicator is at a selected position indicating that a leading roller is approaching the distal portion of the header tubing for release of contact with the header tubing stretched across such leading roller, and a tensioner responsive to said signal for momentarily imparting additional stretch to said distal portion of said header tubing to narrow the passageway through said distal portion when said leading roller reaches the point of release of contact with the header tubing, whereby upon said release of contact a bolus of fluid in a segment of the header tubing between said leading roller and an immediately trailing roller is driven through said narrowed passageway of said distal portion, accelerating flow of the released bolus through the outlet to creating a pulse wave in said fluid leaving said outlet greater than afforded upon said release absent said additional stretch.

5. The pump of claim 4 in which said selected position indicates that the leading roller is at said point of release of contact.

6. The pump of claim 4 further comprising a timer paced by the speed of rotation of said carrier and outputting a signal to signal said tensioner to release the tension momentarily imparted to the distal end of said header tubing after the carrier has rotated a predetermined amount before said trailing roller has approached the said point of release of contact as a leading roller.

7. The pump of claim 1 further comprising connectors for connecting said inlet of said proximal portion end of said header tubing to feed tubing that comprises the receiving line of an extracorporeal circuit at the distal end of the feed tubing and for connecting said outlet of said distal portion end of said header tubing to return tubing that comprises a return line of said extracorporeal circuit at the proximal end of said return tubing, said connectors each including an external rigid flange intermediate their ends, said yoke cooperating with said flanges for holding said header tubing stretched around said rollers according to the tension placed on said header tubing by said adjuster operative with said yoke.

8. The pump of claim 1 in which each roller is longitudinally arcuate in the direction of the roller axis, with a larger diameter intermediate opposite ends of the roller than the diameter of the roller at the ends of the roller, and are supported on sealed roller bearings.

9. The pump of claim 1 in which said rollers are stainless steel and have a surface polished to a mirror finish.

10. The pump of claim 1 in which said carrier is a pair of spaced discs each on the same axis, each disc having a like diameter in the range from 6 cm to 23 cm.

11. The pump of claim 1 in which the header tubing is selected from a group of members having a ratio of respective major and minor axes of 12 and 9, 17 and 13, 20 and 16, 28 and 22, and 35 and 24.

12. The pump of claim 1, in which said driver includes a motor geared for increasing or decreasing the speed of the carrier and further comprising:

a controller operatively associated with said motor for controlling the rotational speed of said motor, and a speed selector operatively associated with said controller for generating a selected speed signal signifying a selected rotational speed for said carrier wheels.

13. The pump of claim 11 in which said motor has a gear reducer to slow said motor speed to at least 1 rpm.

14. The pump of claim 1 further comprising a power source to said driver and circuitry including a switch connection of said power source to said rotator, a sensor for determining presence of an electrically conductive fluid on said yoke, and circuitry connecting said sensor to said switch, to disconnect said power source from said driver when an electrically conductive fluid is sensed on said yoke by said sensor.

15. A peristaltic pump for pumping fluids, comprising:

a frame having a plurality of rollers spaced equidistantly apart and a carrier for carrying the rollers along a circular path, a driver for rotating said carrier to move said rollers about a pump axis, said rollers each rotating about an axis parallel to the pump axis, the roller axes being radially equidistant from the pump axis, a flexible, distensible, shape memory compliant elastomeric header tubing elliptical in relaxed cross section having a selected major to minor axis ratio more than unity and not exceeding 2 in at least a portion of its length, and of selected length longer than twice the radial distance separating said pump axis and said axes of said rollers, thereby to provide a selected relaxed volumetric capacity, said header tubing having a proximal portion with an inlet end and a distal portion with an outlet end, a holder transverse to and spaced from said pump axis a distance greater than said radial distance and having a pair of openings at the extremities thereof for receiving and holding said proximal inlet and distal outlet ends of said header tubing spaced from said carrier when the header tubing is longitudinally spanned across said rollers with the major axis of the header tubing parallel to the axes of the rollers, an indicator on said carrier and an indication receptor spaced from said indicator and responsive to said indicator to signal when said indicator is at a selected position indicating that a leading roller is approaching the distal portion of the header tubing for release of contact with the header tubing stretched across such leading roller, and a tensioner responsive to said signal for momentarily imparting additional stretch to said distal portion of said header tubing to narrow the passageway through said distal portion when said leading roller reaches the point of release of contact with the header tubing, whereby upon said release of contact a bolus of fluid in a segment of the header tubing between said leading roller and an immediately trailing roller is driven through said narrowed passageway of said distal portion, accelerating flow of the released bolus through the outlet to creating a pulse wave in said fluid leaving said outlet greater than afforded upon said release absent said additional stretch.

16. The pump of claim 15 in which said selected position indicates that the leading roller is at said point of release of contact.

17. The pump of claim 15 further comprising a timer paced by the speed of rotation of said carrier and outputting a signal to signal said tensioner to release the tension momentarily imparted to the distal end of said header tubing after the carrier has rotated a predetermined amount before said trailing roller has approached the said point of release of contact as a leading roller.

18. A peristaltic pumping system for pumping perfusion fluids in an extracorporeal circuit, comprising:

a pair of spaced first and second discs each on the same axis forming a first carrier wheel, at least three rollers rotatably mounted between the discs of said carrier wheel, each roller being mounted on a roller axis parallel to and equidistant from said carrier wheel axis, spaced 120 degrees apart, for rotation both about the axis of said carrier wheels and the axis of the individual roller, a flexible, distensible, shape memory compliant elastomeric header tubing elliptical in relaxed cross section having a selected major to minor axis ratio more than unity and not exceeding 2 in at least a portion of its length, and of selected length longer than twice the radial distance separating said pump axis and said axes of said rollers, thereby to provide a selected relaxed volumetric capacity, said header tubing having a proximal portion with an inlet end and a distal portion with an outlet end, flexible feed and return tubing each of a relaxed cross section smaller than the relaxed cross section of said header tubing, said feed tubing having a distal end with an outlet and said return tubing having a proximal end with an inlet, a feed tubing connector having a central bore, for connecting the inlet in the proximal end of said header tubing to the outlet in the distal end of the feed tubing, a return tubing connector having a central bore, for connecting the outlet in the distal end of said header tubing to the inlet in the proximal end of said return tubing, a yoke transverse to and spaced from said pump axis a distance greater than said radial distance and having a pair of openings at the extremities thereof for receiving and holding said proximal inlet and distal outlet ends of said header tubing spaced from said carrier wheel between each disc of said wheel when the header tubing is longitudinally spanned across said rollers with the major axis of the header tubing parallel to the axes of the rollers, such that the proximal and distal portions of the header tubing do not converge toward each other, an adjuster operatively cooperative with said yoke for moving said yoke and both said inlet and outlet ends of the header tubing held in said yoke uniformly toward or away from said pump axis to tension the header tubing across said rollers sufficiently to restrict the patency of the header tubing across the rollers and to decrease the relaxed compliance of the header tubing to an extent providing a selected flow rate for liquid moved through said header tubing upon rotation of said carrier, a driver for rotating said carrier wheel about said carrier wheel axis to cause said rollers to advance in a circular direction proceeding from near said proximal end of the header tubing to near said distal end of the header tubing, thereby defining successively segments of said header tubing between leading and trailing pairs of said rollers, each leading roller becoming the trailing roller of the rotationally preceding segment, whereby each segment can contain a bolus of extracorporeal fluid in fluid communication with a bolus in an adjacent segment of said header tubing on filling of said extracorporeal circuit with fluid, an indicator on said carrier wheel and an indication receptor spaced from said indicator and responsive to said indicator to signal when said indicator is at a selected position indicating that a leading roller is approaching the distal portion of the header tubing for release of contact with the header tubing stretched across such leading roller, and a tensioner responsive to said signal for momentarily imparting additional stretch to said distal portion of said header tubing to narrow the passageway through said distal portion when said leading roller reaches the point of release of contact with the header tubing, whereby upon said release of contact a bolus of fluid in a segment of the header tubing between said leading roller and an immediately trailing roller is driven through said narrowed passageway of said distal portion, accelerating flow of the released bolus through the outlet to creating a pulse wave in said fluid leaving said outlet and entering the return tubing greater than afforded upon said release absent said additional stretch.

19. The system of claim 18 comprising:

a third disc on the same axis as said carrier wheel axially spaced from an adjacent said first or second disk, thereby providing a second carrier wheel on the same axis, said second carrier wheel having at least three rollers rotatably mounted between said third disc and said adjacent disc of the first carrier wheel, each roller being mounted on a roller axis parallel to and equidistant from said carrier wheel axis and spaced 120 degrees apart from each other and 60 degrees apart from the rollers of the first carrier wheel, for rotation both about the axis of said second carrier wheel and the axis of the individual rollers of the second carrier wheel, a flexible, distensible, shape memory compliant elastomeric second header tubing elliptical in relaxed cross section having a selected major to minor axis ratio more than unity and not exceeding 2 in at least a portion of its length, and of selected length longer than twice a second radial distance separating said pump axis and said axes of said rollers of said second carrier wheel, thereby to provide a second selected relaxed volumetric capacity, said second header tubing having a proximal portion with an inlet end and a distal portion with an outlet end, flexible second feed and second return tubing each of a relaxed cross section smaller than the relaxed cross section of said second header tubing, said second feed tubing having a distal end with an outlet and said second return tubing having a proximal end with an inlet, a second feed tubing connector having a central bore, for connecting the inlet in the proximal end of said second header tubing to the outlet in the distal end of the second feed tubing, a second return tubing connector having a central bore, for connecting the outlet in the distal end of said second header tubing to the inlet in the proximal end of said second return tubing, a second yoke transverse to and spaced from said pump axis a distance greater than said second radial distance and having a pair of openings at the extremities thereof for receiving and holding said proximal inlet and distal outlet ends of said second header tubing spaced from said second carrier wheel between each disc of said wheel when the header tubing is longitudinally spanned across said rollers of the second carrier wheel with the major axis of the header tubing parallel to the axes of such rollers, such that the proximal and distal portions of the second header tubing do not converge toward each other.

20. The system of claim 19 further comprising:

a second indicator on said second carrier wheel and a second indication receptor spaced from said second indicator and responsive to said second indicator to signal when said second indicator is at a selected position indicating that a leading roller in said second carrier wheel is approaching the distal portion of the second header tubing for release of contact with the second header tubing stretched across such leading roller, and a second tensioner responsive to said signal from said second indication receptor for momentarily imparting additional stretch to said distal portion of said second header tubing to narrow the passageway through said distal portion thereof when said leading roller reaches the point of release of contact with the second header tubing, whereby upon said release of such contact a bolus of fluid in a segment of the second header tubing between said leading roller and an immediately trailing roller is driven through said narrowed passageway of said distal portion of said second header tubing, accelerating flow of the released bolus through the outlet thereof to create a pulse wave in said fluid leaving said outlet and entering the second return tubing greater than afforded upon said release absent said additional stretch.

21. A method of providing pulsatile flow in a return line of an extracorporeal circuit, comprising stretching a portion of a flexible, distensible, shape memory compliant, elastomeric header tubing around at least two of a plurality of rollers spaced equidistantly apart on a carrier rotatable about a pump axis for carrying the rollers on a circular path, the rotors being rotatable each on their own axis parallel to the pump axis, the patency of the header tubing being restricted where it is stretched across the rollers, restraining said header tubing at an end of a proximal portion thereof and at an end of a distal portion thereof to provide a selected amount of stretching tension on said header tubing, said proximal portion end having an inlet and said distal portion end having an outlet, connecting said inlet of said proximal portion end of said header tubing to feed tubing that comprises the receiving line of said extracorporeal circuit at the distal end of the feed tubing and connecting said outlet of said distal portion end of said header tubing to return tubing that comprises a return line of said extracorporeal circuit at the proximal end of said return tubing, receiving fluid in said circuit to fill the circuit with fluid, rotating said carrier about a pump axis to advance said rollers in said circular path proceeding from a contact with said proximal portion of the header tubing to a contact with said distal portion of the header tubing, thereby defining successively segments of said header tubing between leading and trailing pairs of said rollers, each trailing roller becoming the leading roller of a rotationally following segment, each segment containing a bolus of fluid in fluid communication with a bolus in an adjacent segment of said header tubing, and momentarily imparting additional stretch to said distal portion of said header tubing to narrow the passageway through said distal portion when said leading roller of a segment reaches the point of release of contact with said header tubing, whereby upon said release of said contact the bolus in said segment released by said leading roller is driven through said narrowed passageway of said distal portion, thereby accelerating flow of the released bolus through said outlet creating a pulse wave in said fluid in said return line greater than afforded by said header tubing upon said release absent said additional stretch.

22. The method of claim 21 in which said step of restraining includes holding said proximal inlet and distal outlet ends of said header tubing spaced from said carrier when the header tubing is longitudinally across at least two of said rollers, such that the proximal and distal portions of the header tubing do not converge toward each other.

23. A method of adjusting the flow rate of liquid propelled through the return line of an extracorporeal circuit, comprising:

stretching a portion of a flexible, distensible, shape memory compliant, elastomeric header tubing around at least two of a plurality of rollers spaced equidistantly apart on a carrier rotatable about a pump axis for carrying the rollers on a circular path, the rotors being rotatable each on their own axis parallel to the pump axis, the patency of the header tubing being restricted where it is stretched across the rollers, restraining said header tubing at an end of a proximal portion thereof and at an end of a distal portion thereof to provide a selected amount of stretching tension on said header tubing, said proximal portion end having an inlet and said distal portion end having an outlet, connecting said inlet of said proximal portion end of said header tubing to feed tubing that comprises the receiving line of said extracorporeal circuit at the distal end of the feed tubing and connecting said outlet of said distal portion end of said header tubing to return tubing that comprises a return line of said extracorporeal circuit at the proximal end of said return tubing, receiving fluid in said circuit to fill the circuit with fluid, rotating said carrier about a pump axis to advance said rollers in said circular path proceeding from a contact with said proximal portion of the header tubing to a contact with said distal portion of the header tubing, thereby defining successively segments of said header tubing between leading and trailing pairs of said rollers, each trailing roller becoming the leading roller of a rotationally following segment, each segment containing a bolus of fluid in fluid communication with a bolus in an adjacent segment of said header tubing, and moving both said inlet and outlet ends of the header tubing uniformly toward or away from said pump axis to tension the header tubing across said rollers sufficiently to adjust the patency of the header tubing across the rollers and the relaxed compliance of the header tubing to provide a desired adjusted flow rate for liquid moved through said header tubing upon rotation of said carrier.

24. The method of claim 23 comprising controlling the stroke volume of each said bolus by selecting from among factors including the radial distance of said rollers from said pump; the profile of the relaxed cross section of the header tubing; the compliance of the header tubing; the length of the header tubing; the amount of stretch adjustment imparted to the header tubing for a particular combination of header tubing length, cross sectional profile and compliance, and carrier roller radii; and the speed of rotation of the carrier.

25. The method of claim 23 wherein the profile of the relaxed cross section of said header tubing is elliptical, and wherein the major axis of the elliptical header tubing is parallel to the axes of the rollers when the header tubing is stretched across at least two of the rollers.

26. A peristaltic pump for pumping fluids, comprising:

a frame having a plurality of rollers spaced equidistantly apart and a carrier for carrying the rollers along a circular path, a driver for rotating said carrier to move said rollers about a pump axis, said rollers each rotating about an axis parallel to the pump axis, the roller axes being radially equidistant from the pump axis, a flexible, distensible, shape memory compliant elastomeric header tubing elliptical in relaxed cross section having a selected major to minor axis ratio, and of selected length longer than twice the radial distance separating said pump axis and said axes of said rollers, thereby to provide a selected relaxed volumetric capacity, said header tubing having a proximal portion with an inlet end and a distal portion with an outlet end, a holder transverse to and spaced from said pump axis a distance greater than said radial distance and having a pair of openings at the extremities thereof for receiving and holding said proximal inlet and distal outlet ends of said header tubing spaced from a said carrier when the header tubing is longitudinally spanned across said rollers with the major axis of the header tubing parallel to the axes of the rollers, and an adjuster operatively cooperative with said holder for moving said holder and both said inlet and outlet ends of the header tubing held in said holder uniformly toward or away from said pump axis to tension the header tubing across said rollers sufficiently to restrict the patency of the header tubing across the rollers and to decrease the relaxed compliance of the header tubing to an extent providing a selected flow rate for liquid moved through said header tubing upon rotation of said carrier.

27. The peristaltic pump of claim 26, further comprising:

an indicator on said carrier and an indication receptor spaced from said indicator and responsive to said indicator to signal when said indicator is at a selected position indicating that a leading roller is approaching the distal portion of the header tubing for release of contact with the header tubing stretched across such leading roller, and a tensioner responsive to said signal for momentarily imparting additional stretch to said distal portion of said header tubing to narrow the passageway through said distal portion when said leading roller reaches the point of release of contact with the header tubing, whereby upon said release of contact a bolus of fluid in a segment of the header tubing between said leading roller and an immediately trailing roller is driven through said narrowed passageway of said distal portion, accelerating flow of the released bolus through the outlet to create a pulse wave in said fluid leaving said outlet greater than afforded upon said release absent said additional stretch.

* * * * *